US007785100B1

(12) United States Patent
Swanson et al.

(10) Patent No.: US 7,785,100 B1
(45) Date of Patent: Aug. 31, 2010

(54) BURNER ASSEMBLY WITH TURBULENT TUBE FUEL-AIR MIXER

(76) Inventors: Malcolm Swanson, 2213 Garrett's Chapel Rd., Chickamauga, GA (US) 30707; Michael Swanson, 2087 Garrett's Chapel Rd., Chickamauga, GA (US) 30707

( * ) Notice: Subject to any disclaimer, the term of this patent is extended or adjusted under 35 U.S.C. 154(b) by 1043 days.

(21) Appl. No.: 11/441,903

(22) Filed: May 26, 2006

Related U.S. Application Data

(63) Continuation-in-part of application No. 10/957,252, filed on Oct. 1, 2004, now abandoned.

(51) Int. Cl.
*F23C 5/08* (2006.01)

(52) U.S. Cl. ..... 431/181; 431/8; 431/278

(58) Field of Classification Search ..... 431/8, 431/9, 10, 12, 181, 187, 254, 278, 284
See application file for complete search history.

(56) References Cited

U.S. PATENT DOCUMENTS 5,415,539 A * 5/1995 Musil ..... 431/181
5,573,396 A * 11/1996 Swanson ..... 432/106
5,931,660 A * 8/1999 Amrhein et al. ..... 431/328

* cited by examiner

*Primary Examiner*—Alfred Basichas
(74) *Attorney, Agent, or Firm*—Chambliss, Bahner & Stophel, P.C.

(57) ABSTRACT

A burner assembly including a housing having an air inlet and a burner end, a motor, and an impeller mounted in the housing. The impeller is in fluid communication with the air inlet, in mechanical communication with the motor, and adapted to direct air from the air inlet towards the burner end of the housing. The burner assembly also includes a plurality of gas injection tubes that are disposed substantially parallel to each other. Each of the plurality of gas injection tubes includes a tube inlet end, a tube outlet end and at least one aperture. In addition, the burner assembly includes a first tube sheet disposed near the tube inlet ends of the plurality of gas injection tubes and a second tube sheet disposed near the tube outlet ends of the plurality of gas injection tubes. The burner assembly further includes a spin vane having at least one spin vane blade. The spin vane is mounted in the burner end of the housing and adapted to direct the flow of air in the burner end. The burner assembly still further includes an igniter mounted in the burner end of the housing. The igniter is adapted to ignite the air and fuel mixture in the burner end of the housing to produce a main flame.

19 Claims, 24 Drawing Sheets

BURNER ASSEMBLY WITH TURBULENT TUBE FUEL-AIR MIXER

RELATED APPLICATIONS

This is a continuation-in-part application of patent application entitled Burner Assembly, which was filed on Oct. 1, 2004 and assigned Ser. No. 10/957,252 now abandoned.

FIELD OF THE INVENTION

This invention relates generally to an improved burner assembly, and more particularly, to an improved burner assembly for heating and drying aggregate materials used in connection with the production of hot mix asphalt.

BACKGROUND AND DESCRIPTION OF THE PRIOR ART

It is known to use a burner assembly to heat and dry aggregate materials used in connection with the production of hot mix asphalt. See, e.g., U.S. Pat. No. 5,700,143, No. 5,511,970, No. 4,559,009 and No. 4,298,337. However, conventional burner assemblies suffer from several disadvantages. For example, conventional burner assemblies are incapable of producing a flame configuration satisfactory for asphalt production in a variety of different-sized combustion chambers. As a result, conventional burner assemblies typically include adjustable spin vanes or spin racks to accommodate different-sized combustion chambers. For example, U.S. Pat. No. 6,488,496 of Feese et al. describes a compact combination burner with an adjustable spin rack. Adjustable spin vanes, however, increase the cost of manufacture and maintenance and the amount of labor required to operate the burner. In addition, conventional burner assemblies do not adequately mix combustion air with fuel such as natural gas and/or vaporized liquid propane. As a result, conventional burner assemblies produce unwanted levels of harmful CO, NOx, $CO_2$ and VOC emissions.

It would be desirable, therefore, if an apparatus could be provided that would selectively fire on gaseous fuel, liquid fuel, or both gaseous and liquid fuel. It would also be desirable if such an apparatus could be provided that would fire on gaseous and/or liquid fuels without physically altering the components of the apparatus, changing the firing rate of the apparatus, or shutting down the apparatus. It would be further desirable if such an apparatus could be provided that would fire on oil or liquid propane without changing the atomizing nozzle. It would be still further desirable if such an apparatus could be provided that would supply natural gas or propane around the atomizing nozzle for use as pilot fuel. In addition, it would be desirable if such an apparatus could be provided that would produce a stable flame configuration having a short flame length and a narrow flame diameter adapted for use on a wide variety of different-sized combustion chambers. It would also be desirable if such an apparatus could be provided that would more completely and uniformly mix fuel and air in order to obtain more rapid combustion and improve combustion intensity, thereby reducing the combustion space required in the asphalt drum. It would be further desirable if such an apparatus could be provided that would more adequately mix combustion air with fuel such as natural gas and/or vaporized liquid propane such that levels of harmful CO, NOx, $CO_2$ and VOC emissions are minimized. In addition, it would be desirable if such an apparatus could be provided that would be capable of firing on low excess air pre-mix gas. It would also be desirable if such an apparatus could be provided that would produce a stabilizing gas base flame. It would be further desirable if such an apparatus could be provided that would reduce the temperature of the dryer drum breech plate where the burner is mounted. It would be still further desirable if such an apparatus could be provided that would eliminate the need to adjust spin vanes to achieve a desired flame configuration. It would also be desirable if such an apparatus could be provided that would be less complicated and expensive to manufacture, operate and maintain than conventional burners.

ADVANTAGES OF THE PREFERRED EMBODIMENTS OF THE INVENTION

Accordingly, it is an advantage of the preferred embodiments of the invention described and claimed herein to provide an apparatus capable of selectively firing on gaseous fuel, liquid fuel, or both gaseous and liquid fuel. It is also an advantage of the preferred embodiments of the invention to provide an apparatus capable of firing on gaseous and/or liquid fuels without physically altering the components of the apparatus, changing the firing rate of the apparatus, or shutting down the apparatus. It is a further advantage of the preferred embodiments of the invention to provide an apparatus adapted to fire on oil or liquid propane without changing the atomizing nozzle. It is another advantage of the preferred embodiments of the invention to provide an apparatus that is capable of supplying natural gas or propane to the atomizing nozzle for use as pilot fuel. It is also an advantage of the preferred embodiments of the invention to provide an apparatus for producing a stable main flame configuration that has a short flame length and a narrow flame diameter. It is also an advantage of the preferred embodiments of the invention to provide an apparatus for producing a main flame configuration that is adapted for use on a wide variety of different-sized combustion chambers having different-sized combustion spaces. It is another advantage of the preferred embodiments of the invention to provide an apparatus that more rapidly, completely, and uniformly mixes fuel and air, thereby providing a more rapid combustion, improving combustion intensity and reducing the combustion space required in the asphalt drum. It is yet another advantage of the preferred embodiments of the invention to more adequately mix combustion air with fuel such as natural gas and/or vaporized liquid propane such that levels of harmful CO, NOx, $CO_2$ and VOC emissions are minimized. It is a further advantage of the preferred embodiments of the invention to provide an apparatus capable of firing on low excess air pre-mix gas. It is a still further advantage of the preferred embodiments of the invention to provide an apparatus for producing a stabilizing gas base flame. It is still another advantage of the preferred embodiments of the invention to provide an apparatus that reduces the temperature of the dryer drum breech plate. It is a further advantage of the preferred embodiments of the invention to provide an apparatus that eliminates the need for adjustable spin vanes in order to achieve a desired flame configuration. It is another advantage of the preferred embodiments of the invention to provide an apparatus having improved aerodynamics which reduce energy consumption and body pressure and produce a more free flowing burner assembly. It is still another advantage of the preferred embodiments of the invention to provide an apparatus which produces reduced noise levels during operation. It is yet another advantage of the preferred embodiments of the invention to provide an apparatus that is less complicated and expensive to manufacture, operate and maintain than conventional burner assemblies.

Additional advantages of the invention will become apparent from an examination of the drawings and the ensuing description.

EXPLANATION OF TECHNICAL TERMS

As used herein, the term "mounted about the periphery of the housing" means that the plurality of gas injection tubes are mounted within the interior of the housing of the burner assembly such that the tubes do not extend to the center of housing. More particularly, the term "mounted about the periphery of the housing" means that the plurality of gas injection tubes are mounted within the interior of the housing of the burner assembly such that the tubes leave an open area in the center of the housing through which the primary air tube, the pilot assembly and the like may pass unimpeded.

SUMMARY OF THE INVENTION

The invention claimed herein comprises a burner assembly including a housing having an air inlet and a burner end, a motor, and an impeller mounted in the housing. The impeller is in fluid communication with the air inlet, in mechanical communication with the motor, and adapted to direct air from the air inlet towards the burner end of the housing. The burner assembly also includes a plurality of gas injection tubes that are disposed substantially parallel to each other. Each of the plurality of gas injection tubes includes a tube inlet end, a tube outlet end and at least one aperture. In addition, the burner assembly includes a first tube sheet disposed near the tube inlet ends of the plurality of gas injection tubes and a second tube sheet disposed near the tube outlet end of the plurality of gas injection tubes. The burner assembly further includes a spin vane comprising at least one spin vane blade. The spin vane is mounted in the burner end of the housing and adapted to direct the flow of air in the burner end. The burner assembly still further includes an igniter mounted in the burner end of the housing. The igniter is adapted to ignite the air and fuel mixture in the burner end of the housing to produce a main flame.

In a preferred embodiment, the plurality of gas injection tubes are mounted about the periphery of the housing, and the first tube sheet and the second tube sheet produce a substantially sealed gas injection chamber. In the preferred embodiment, a gas manifold is adapted to convey gaseous fuel to the substantially sealed gas injection chamber, the gaseous fuel enters the plurality of gas injection tubes through the apertures in the gas injection tubes, and the gaseous fuel mixes with combustion air in the plurality of gas injection tubes. Also in the preferred embodiment, a liquid fuel system is provided in the burner assembly. In the preferred embodiment, an primary air tube is mounted within the housing. The primary air tube has a primary air tube inlet end located downstream of the impeller and a primary air tube outlet end located adjacent to the burner end. Also in this preferred embodiment, an atomizing nozzle is mounted on the outlet end of the primary air tube, a liquid fuel supply tube is mounted within the primary air tube so as to convey liquid fuel to the atomizing nozzle, a compressed atomizing air supply tube is mounted within the primary air tube so as to convey compressed air to the atomizing nozzle, and a swirl plate is mounted around the periphery of the primary air tube outlet end.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
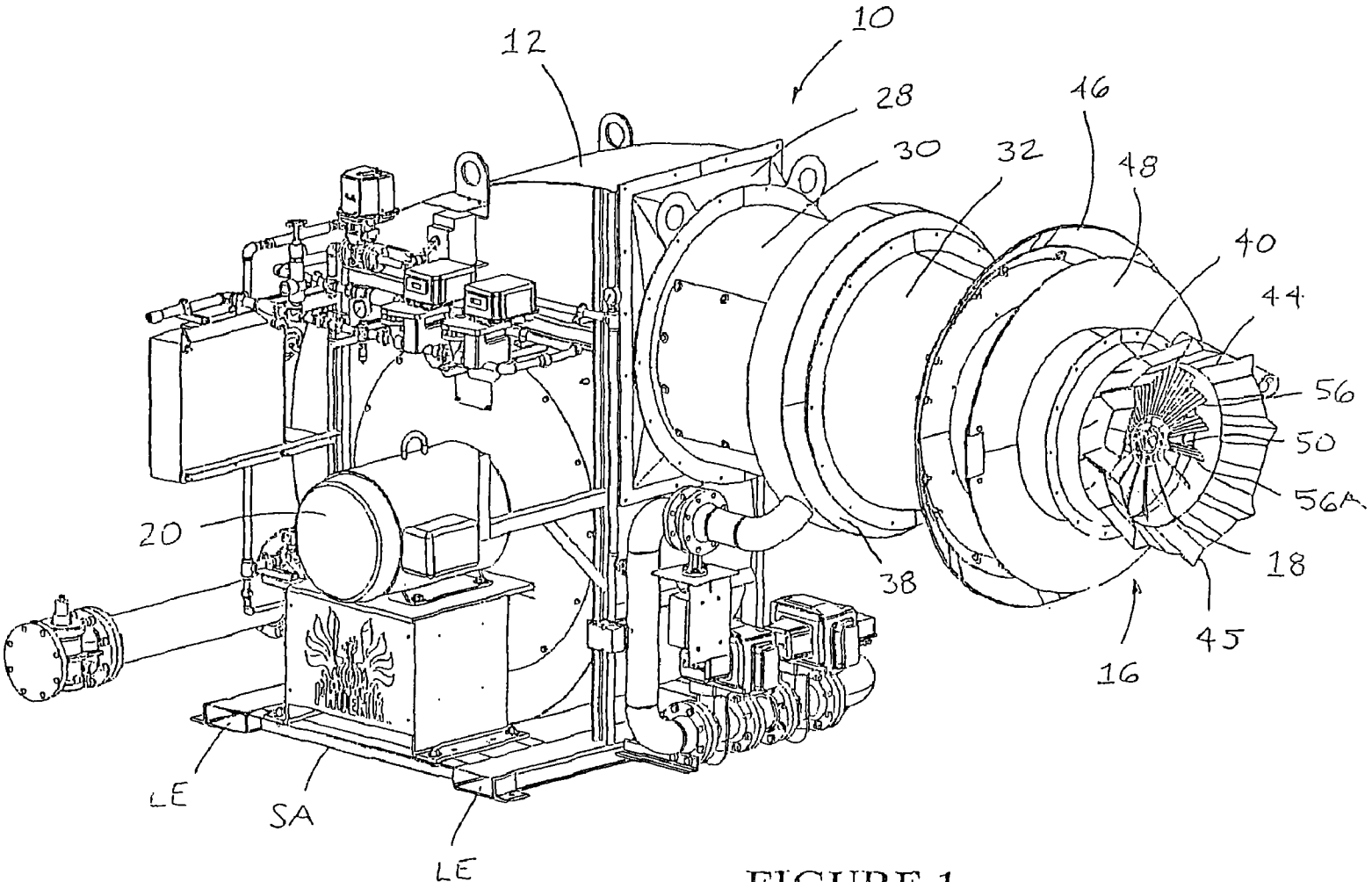
FIG. 1 is a perspective view of a preferred embodiment of the burner assembly in accordance with the present invention.

Referring now to the drawings, the apparatus of the invention described herein is illustrated by FIGS. 1 through 25. As shown in FIGS. 1 through 7, the preferred burner assembly is designated generally by reference numeral 10. The preferred burner assembly 10 is built on skid assembly SA having lifting tubes LE that allow the assembly to be handled with a fork truck or hoist. The preferred burner assembly is adapted to selectively fire on a gaseous fuel such as natural gas or a liquid fuel such as fuel oil, or both.

Referring still to FIGS. 1 through 7, the preferred burner assembly 10 comprises housing 12 having air inlet 14 (see FIGS. 3 and 6) and burner end 16 downstream from the air inlet. The preferred housing 12 generally contains the working components of the burner assembly and provides an outer shell within which combustion air may be pressurized, conveyed from the air inlet to the burner end, and mixed with fuel to produce a flame at the burner end of the housing. burner end 16 is provided with opening 18 through which a flame is developed and burned. While FIGS. 1 through 7 illustrate a preferred configuration for housing 12, it is understood that housing 12 may be of any suitable configuration. It is also contemplated within the scope of the invention that housing 12 may be either a unitary structure or a modular structure comprising two or more separable components.

Figure 2:
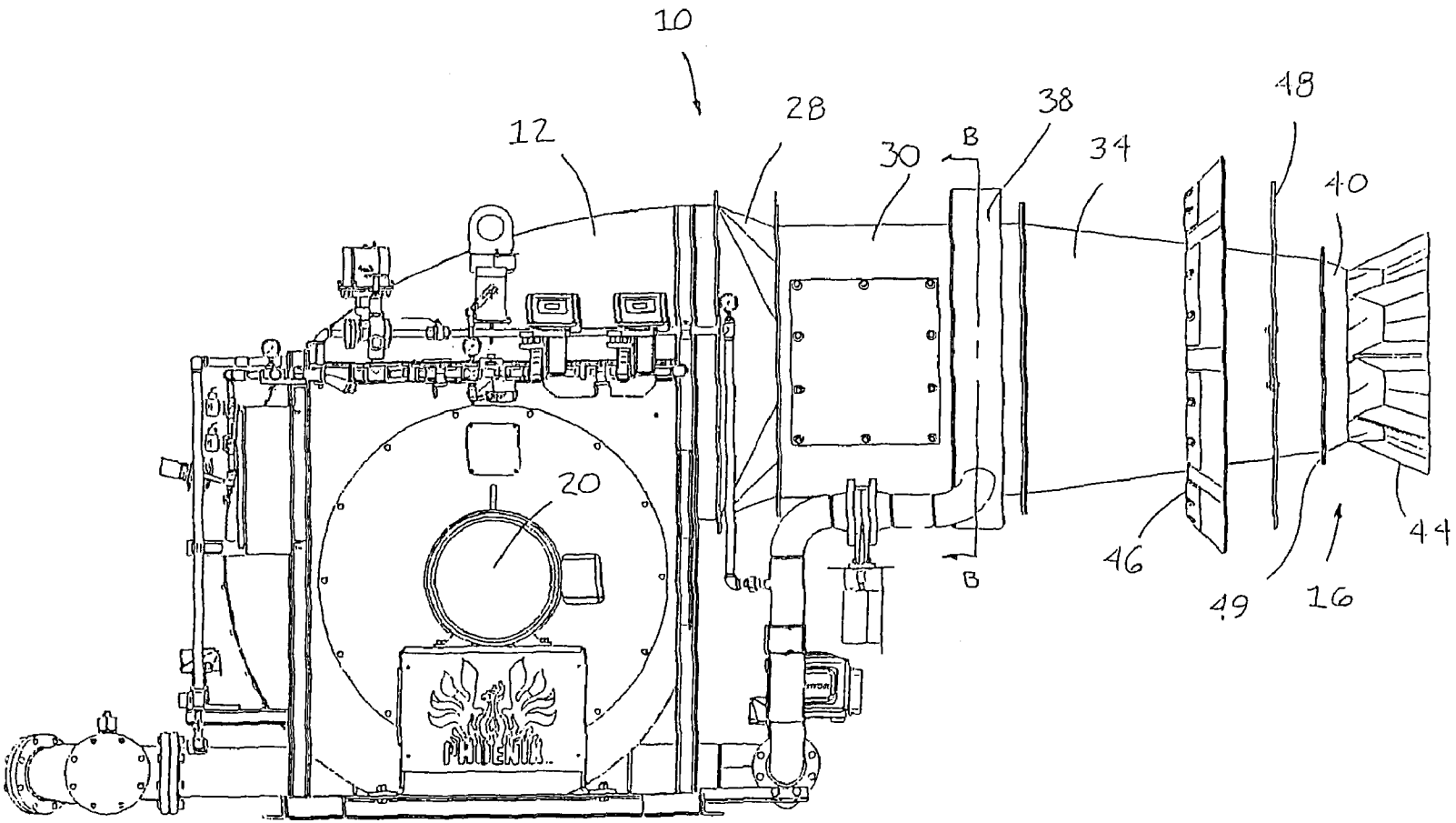
FIG. 2 is a front view of the preferred embodiment of the burner assembly illustrated in FIG. 1.
Figure 3:
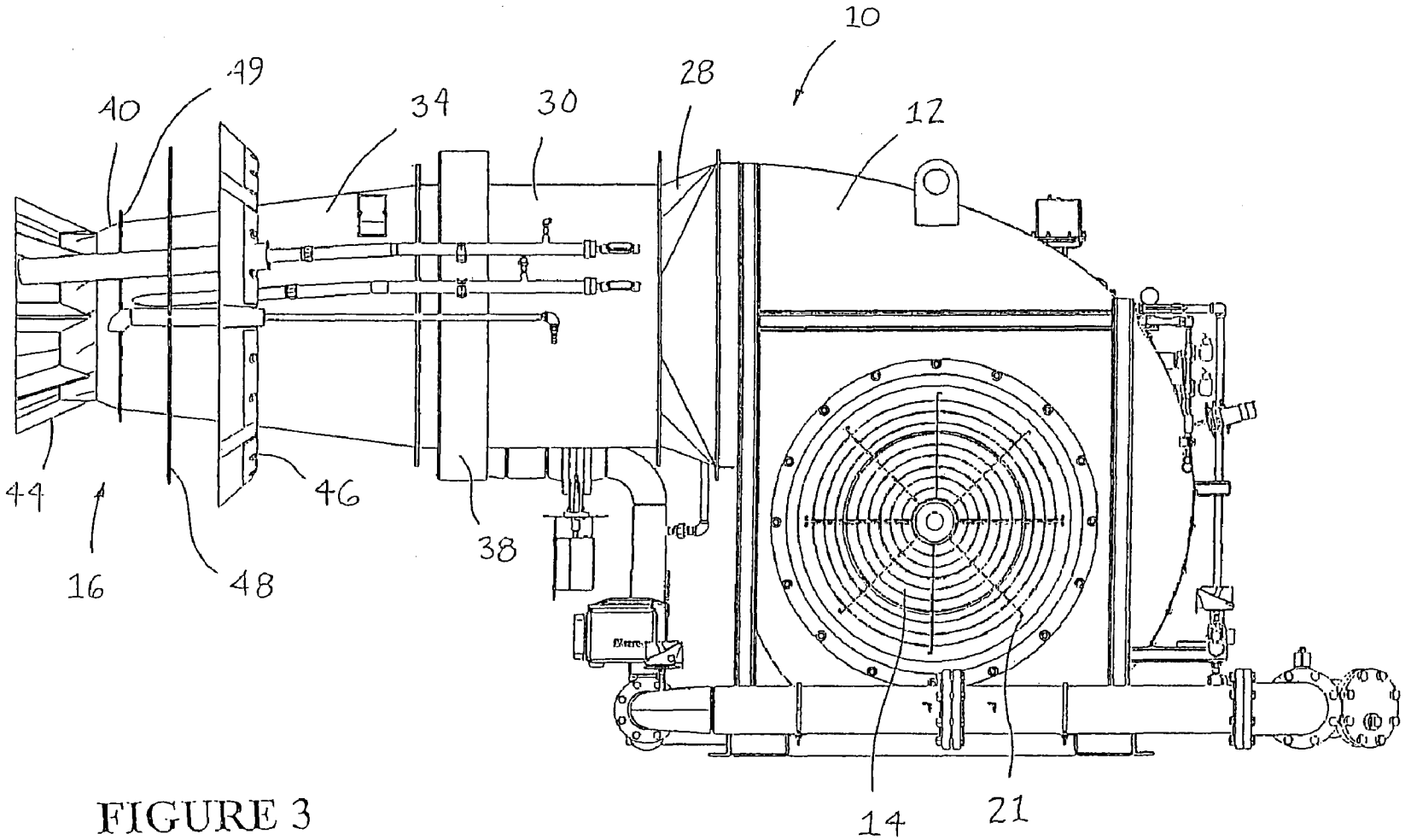
FIG. 3 is a rear view of the preferred embodiment of the burner assembly illustrated in FIGS. 1-2.

As shown in FIGS. 1 through 3, the preferred burner assembly 10 also includes motor 20. The preferred motor 20 is in mechanical communication with impeller 21 such as by being mounted to a shaft (not shown) that is connected to impeller 21 (see FIG. 3). The preferred impeller 21 is adapted to draw air into the housing through air inlet 14 (see FIG. 3) and convey pressurized air from the air inlet downstream towards the burner end of housing 12. The preferred air inlet 14 is adapted to supply air to the burner assembly. The preferred motor 20 promotes high combustion air exit velocities and rapid mixing for higher combustion intensity. The preferred motor 20 is also a variable frequency AC motor and is adapted to vary the speed of impeller 21, thereby varying the flow of air in the housing of the burner assembly. While the preferred motor is a variable frequency AC motor, it is contemplated within the scope of the invention that any suitable device for conveying pressurized air towards the burner end of the assembly may be used. The preferred impeller 21 may be a backward curved impeller or any other suitable device for conveying pressurized air.

Referring still to FIGS. 1 through 3, the preferred burner assembly 10 also includes transition section 28, gas injection section 30 and pre-mix cone 34. The preferred transition section 28 is mounted to the housing downstream of the impeller and adapted to direct air flow from the impeller to the burner end. The preferred gas injection section 30 is mounted to the transition section downstream of the impeller and adapted to direct air flow from the impeller to the burner end. More particularly, the preferred gas injection section 30 includes at least one pre-mix gas injection nozzle 36 (see FIGS. 8-10). The preferred pre-mix gas injection nozzles 36 are adapted to provide gaseous fuel such as natural gas to the interior of the gas injection section via gas manifold 38. The preferred pre-mix cone 34 is located downstream of the impeller and adapted to direct air flow from the impeller to the burner end. More particularly, the preferred pre-mix cone 34 is adapted to facilitate the complete and uniform mixing of fuel and air in the burner assembly. In a preferred embodiment, the pre-mix cone is constructed with an included angle of approximately 15°, i.e., approximately 7½° from parallel to the longitudinal axis on the pre-mix cone on each opposing side.

Still referring to FIGS. 1 through 3, the preferred burner assembly 10 further includes converging focusing cone 40 and diverging conical discharge section 44 which are located in the burner end of the housing. The preferred converging focusing cone 40 is removably mounted to the burner assembly and adapted to provide adequate air flow velocity in the burner end of the housing in order to prevent flashbacks. It is contemplated within the scope of the invention that a spin (or swirl) ring (not shown), such as is described and claimed in commonly assigned and copending application Ser. No. 10/356,288, may be mounted on the converging focusing cone in order to improve the configuration of the flame produced at the burner end of the assembly.

Referring still to FIGS. 1 through 3, the preferred diverging conical discharge section 44 is adapted to reduce CO emissions and shape and stabilize the flame produced at the burner end of the assembly. More particularly, the diverging conical discharge section 44 is adapted to act as a heat or radiation shield when the burner assembly is firing on oil. When the burner assembly is firing on gaseous fuel, the preferred diverging conical discharge section 44 acts as a "flame holder." The preferred diverging conical discharge section 44 may be constructed as an integral or unitary structure having at least one expansion and contraction crease 45 adapted to permit the diverging conical discharge section 44 to expand and contract in response to temperature changes. It is also contemplated that the conical discharge section may be constructed without any expansion and contraction creases. It is also preferred that the diverging conical discharge section is welded to the adjustable opening band. It is contemplated within the scope of the invention, however, that the diverging conical cone may comprise more than one component connected together in any suitable manner. Also in a preferred embodiment, the diverging conical discharge section is constructed with an included angle of approximately 35°, i.e., approximately 17½° from parallel to the longitudinal axis of the pre-mix cone on each opposing side. The preferred burner assembly 10 also includes seal skirt 46 and heat shield 48 at the burner end of the housing. Seal skirt 46 and heat shield 48 are adapted to produce a sealed connection between the burner assembly and the dryer drum with which the burner assembly is used. Further, the preferred seal skirt 46 and the preferred heat shield 48 are mounted adjacent to the burner end and adapted to be attached to a rotating drum dryer and prevent air from entering the dryer drum as a result of the close clearance between the heat shield and the dryer drum.

Figure 15:
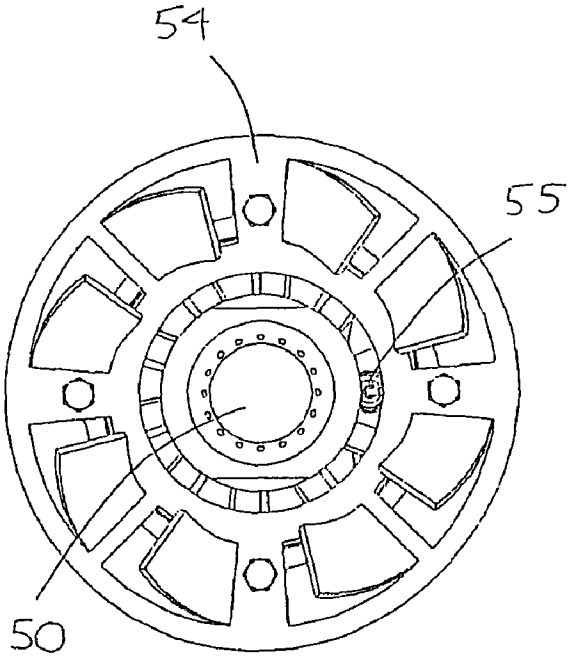
FIG. 15 is a right side view of the preferred pilot assembly of the burner assembly illustrated in FIGS. 1-14.
Figure 16:
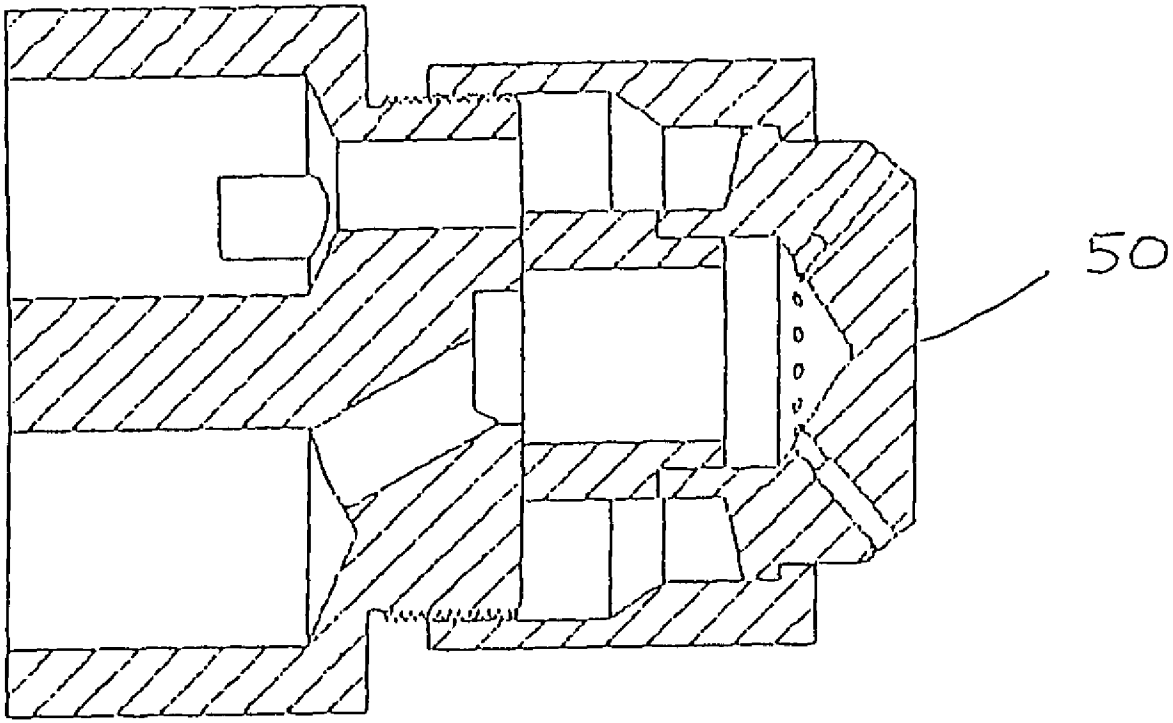
FIG. 16 is a sectional front view of a preferred embodiment of the atomizing nozzle of the burner assembly illustrated in FIGS. 1-15.

Referring now to FIGS. 1, 4, 6, 7 and 14 through 16, the preferred burner assembly 10 also includes atomizing nozzle 50 and pilot assembly 52 (see FIGS. 14 through 16) mounted at the burner end of the burner assembly. The preferred atomizing nozzle 50 is adapted to provide liquid fuel such as fuel oil to the burner end of the housing. The preferred atomizing nozzle 50 is also adapted to fire on gaseous fuel such as natural gas, lean-burn gas, oil or liquid propane. As shown in FIG. 16, the preferred atomizing nozzle 50 is a compressed air-type nozzle such as the nozzle commonly known as the "Y-Jet" type nozzle. The preferred atomizing nozzle 50 is a "Y-Jet" multi-angle atomizing nozzle which has no seals. It is contemplated within the scope of the invention, however, that the atomizing nozzle may be a vortex pintle-style nozzle or any suitable compressed air-type atomizing nozzle adapted to atomize fluids to be used to produce a flame.

Figure 14:
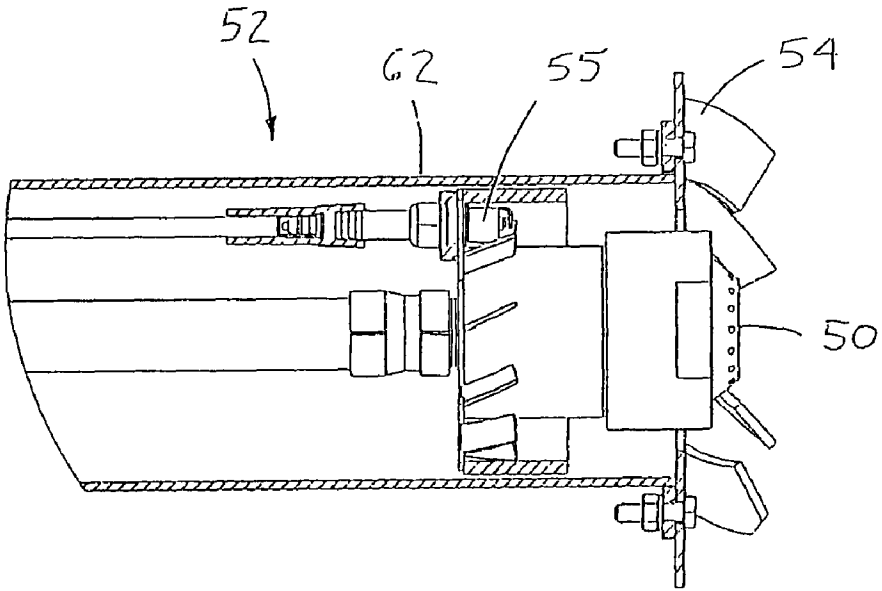
FIG. 14 is a partial sectional front view of a preferred embodiment of the pilot assembly of the burner assembly illustrated in FIGS. 1-13.

Referring now to FIGS. 14 through 15, a preferred embodiment of the pilot assembly 52 of the preferred burner assembly 10 is illustrated. More particularly, the preferred pilot assembly 52 is mounted at the burner end and adapted to produce a pilot flame for igniting the main flame. The preferred pilot assembly 52 is centrally located in the burner end of the housing of the burner assembly and surrounds at least a portion of the atomizing nozzle. As shown in FIG. 14, the preferred pilot assembly 52 uses existing geometry to produce a pilot flame. Indeed, the preferred pilot assembly 52 uses primary air tube 62 for the delivery of natural gas or propane to atomizing nozzle 50. While the preferred nozzle assembly 52 illustrated in FIGS. 14 and 15 is a pre-mix pilot, it is also contemplated within the scope of the invention that the nozzle assembly of the burner assembly described and claimed herein may be a nozzle mix pilot assembly.

Figure 5:
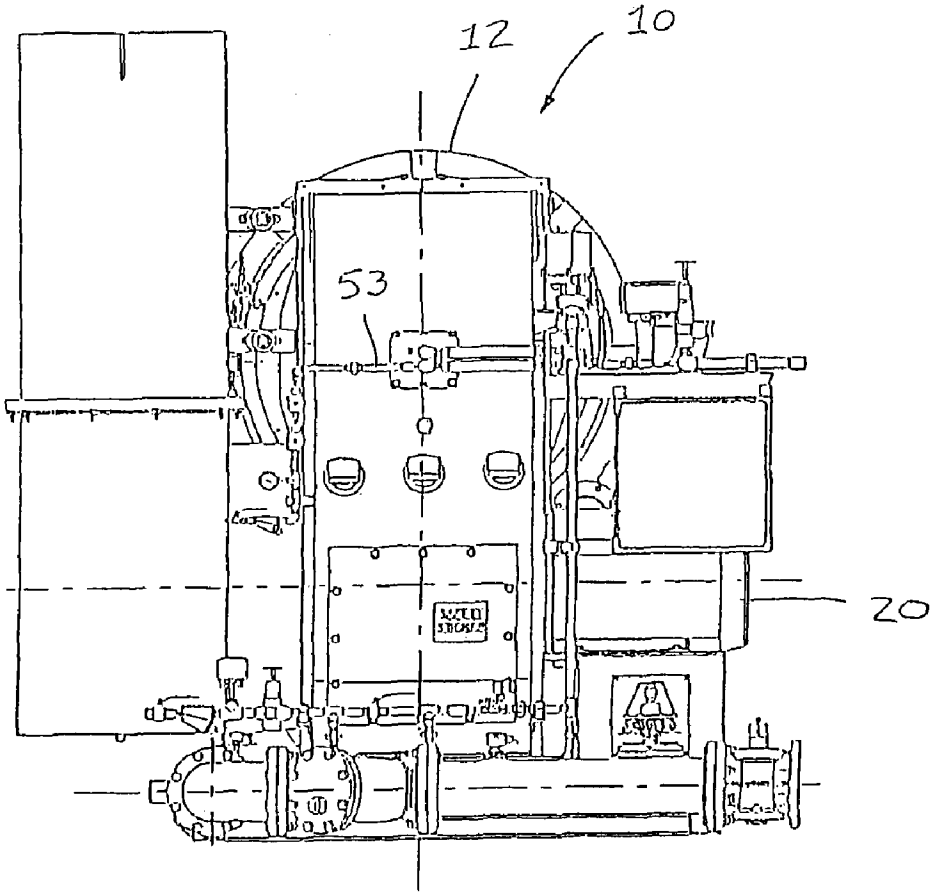
FIG. 5 is a left side view of the preferred embodiment of the burner assembly illustrated in FIGS. 1-4.

Referring still to FIGS. 14 and 15, the preferred pilot assembly 52 is adapted to ignite the mixture of fuel and air in the burner end of the burner assembly. The preferred pilot assembly 52 includes automobile spark plug 55 for igniting the mixture of fuel and air in the burner end, but it is contemplated within the scope of the invention that any suitable source of ignition may be used. As shown in FIG. 5, the preferred pilot assembly 52 includes pilot train 53 which enters the housing of the burner assembly such that the pilot assembly may be centrally located in the burner assembly.

Figure 15A:
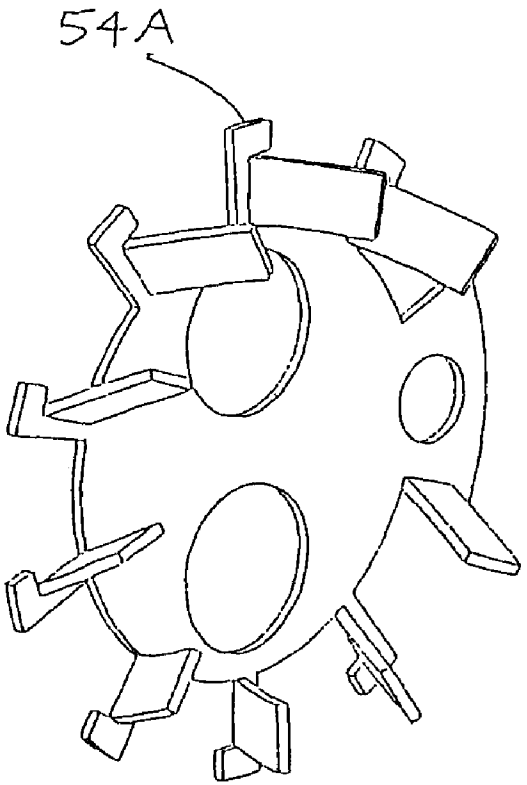
FIG. 15A is a perspective view of an exemplary flapped ring which may mounted in the burner end of the preferred burner assembly of the present invention.

As shown in FIGS. 14 and 15, swirl plate 54 is mounted around the periphery of the outlet end of atomizing nozzle 50. The preferred swirl plate 54 is adapted to direct air flow in the area of atomizing nozzle 50 in order to facilitate the mixture of combustion air and fuel. While FIGS. 14 and 15 illustrate a swirl plate mounted around the periphery of the outlet end of the primary air tube, it is contemplated within the scope of the invention that flapped ring 54A (see FIG. 15A) or any other suitable device adapted to facilitate the mixture of combustion air and fuel may be mounted at the burner end. It is also contemplated that the outlet end of the primary air tube may not include a swirl plate or any other similar device.

Referring now to FIGS. 1, 4, 6 and 11-13, in the preferred embodiment of the burner assembly, spin vane 56 is mounted in the burner end of the assembly upstream of atomizing nozzle 50 and pilot assembly 52. The preferred spin vane 56 is adapted to contribute to the swirling flow of air in the burner end of the burner assembly in order to more completely and uniformly mix the fuel and air in the burner assembly. In addition, the preferred spin vane 56 functions as a stabilizing structure for the main flame produced at the burner end of the burner assembly. The preferred spin vane 56 is mounted radially in the burner end of the burner assembly in an overlapping "pin wheel" configuration. Further, the preferred spin vane 56 is not adjustable. Still further, the preferred spin vane 56 includes a plurality of spin vane blades 56A, each of which is tapered and curved or bent such that the cross-sectional shape of each spin vane blade is non-planar. The tapered configuration of the preferred spin vanes 56 reduces air starvation near the center of the burner end. The non-planar configuration of the preferred spin vanes 56 improves the strength of the spin vane and the resistance to warping.

However, it is contemplated within the scope of the invention that the spin vane may be adjustable. It is further contemplated within the scope of the invention that the spin vane may be mounted in the burner assembly at any suitable location and the spin vane blades may be of any suitable configuration, angle, number and/or spacing adapted to contribute to the swirling flow of air and the stability of the flame produced in the burner end. While FIGS. 1, 4, 6 and 11-13 illustrate only one spin vane section, i.e., the preferred spin vane 56, it is contemplated within the scope of the invention that more than one spin vane section may be included in the burner assembly.

Figure 6:
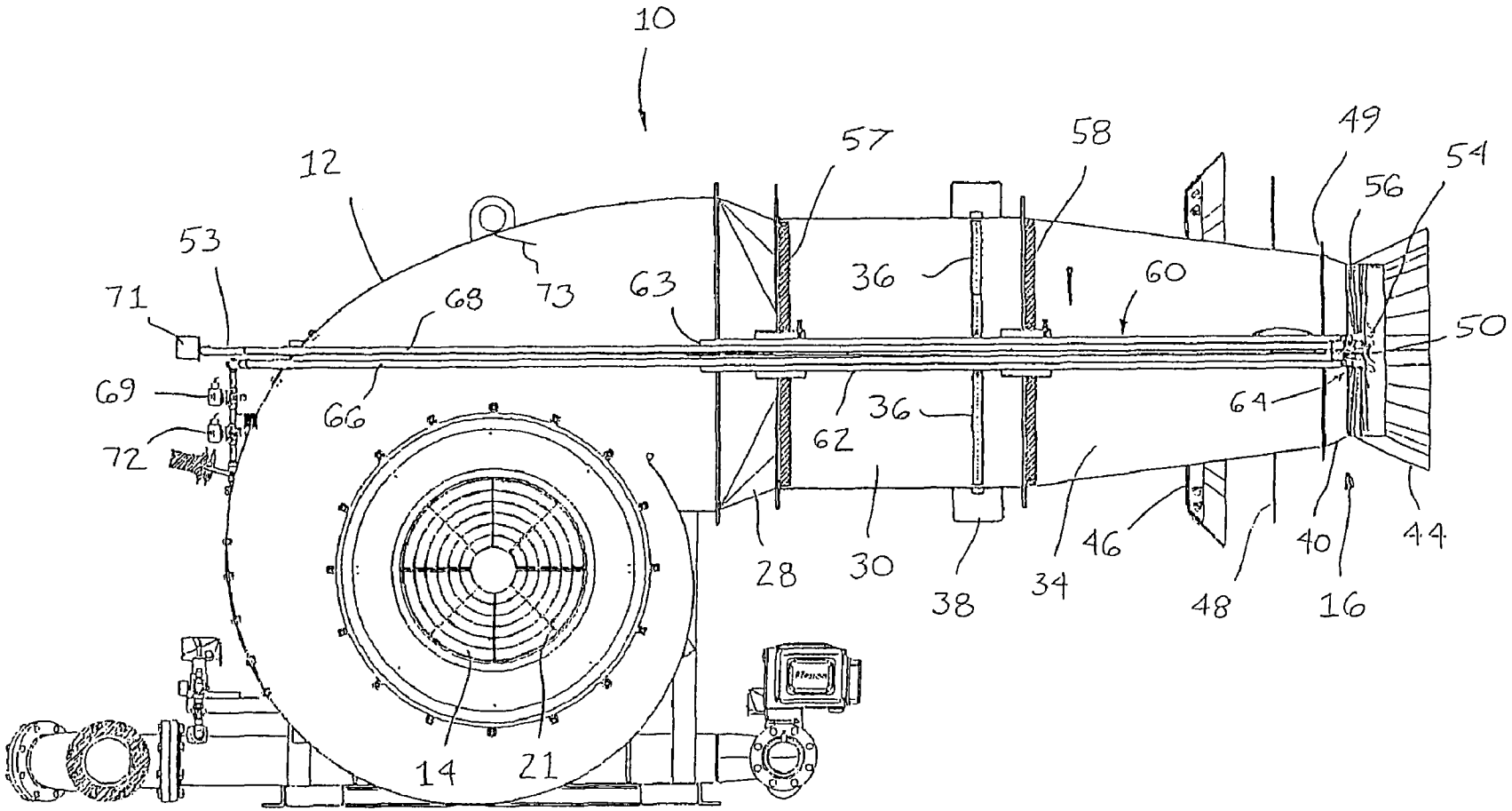
FIG. 6 is a partial sectional front view of the preferred embodiment of the burner assembly illustrated in FIGS. 1-5 taken along sectional line A-A of FIG. 4.

Referring now to FIGS. 4, 6, 7 and 7A, the preferred screens of the preferred burner assembly 10 are illustrated. More particularly, as shown in FIG. 6, the preferred burner assembly 10 includes straightening screen 57 and mixing screen 58. The preferred straightening screen 57 is mounted in the housing of the burner assembly downstream from the impeller and adapted to produce a uniform air flow velocity in the burner assembly. The preferred mixing screen 58 is mounted in the housing of the burner assembly and adapted to produce a uniform air flow velocity in the burner assembly and mix combustion air and fuel in the burner assembly. The preferred straightening screen 57 is mounted upstream of the pre-mix gas injection nozzles and the preferred mixing screen 58 is mounted downstream from the pre-mix gas injection nozzles, but it is contemplated within the scope of the invention that the screens may be mounted in any suitable location in the burner assembly.

Figure 4:
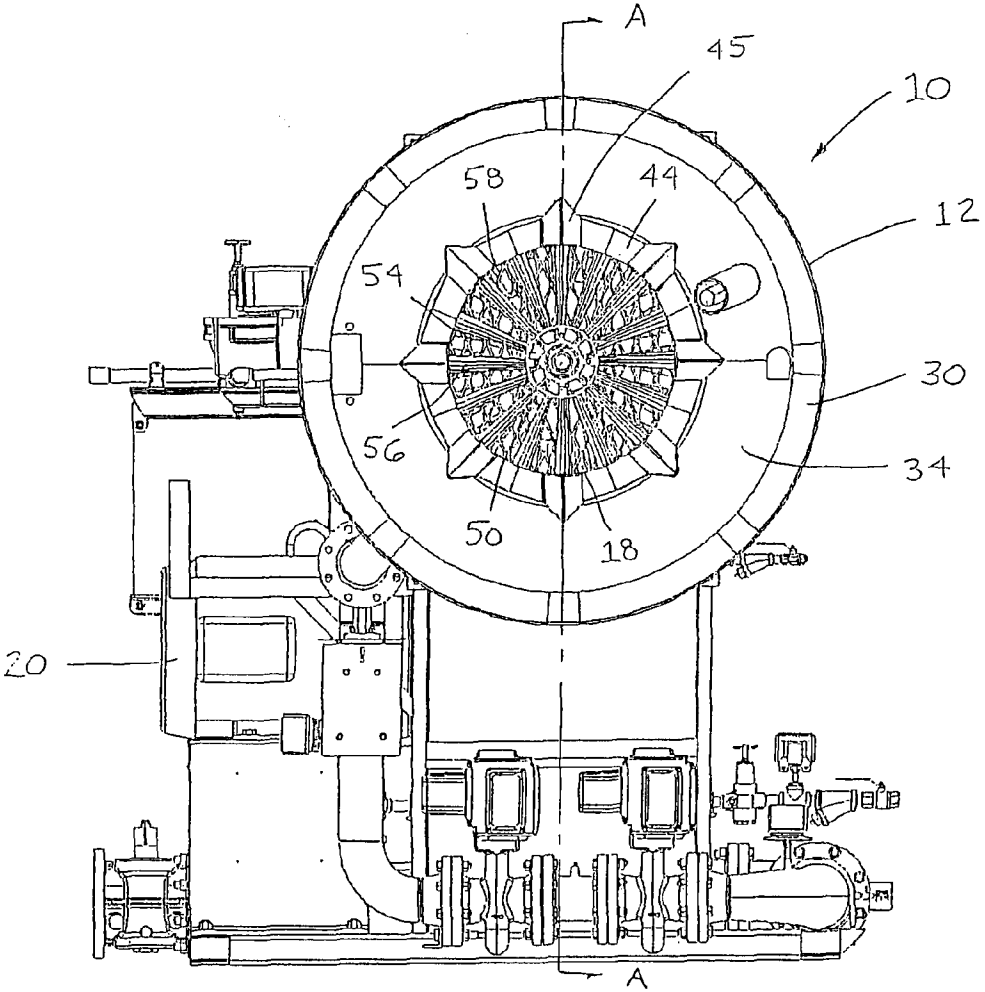
FIG. 4 is a right side view of the preferred embodiment of the burner assembly illustrated in FIGS. 1-3.

Referring now to FIGS. 5 and 6, a left side view and a partial sectional front view of preferred burner assembly 10 taken along line sectional A-A of FIG. 4 are illustrated, respectively. As shown in FIG. 5, the preferred pilot assembly 52, the preferred liquid fuel supply tube 66 and the preferred compressed atomizing air supply tube 68 enter housing 12 such that each may extend along the center of the housing and the interior of the burner assembly towards the burner end. See also FIG. 14. As shown in FIG. 6, the preferred burner assembly 10 includes a liquid fuel system referred to generally by reference numeral 60. The preferred liquid fuel system 60 includes primary air tube 62 which is mounted in the housing of the assembly. As can be appreciated from FIG. 6, some of the pressurized combustion air produced by motor 20 and impeller 21 (see FIGS. 1 and 2) enters the preferred primary air tube 62 at inlet end 63 which is located downstream of the impeller and upstream of the burner end. The preferred outlet end 64 is opposite inlet end 63 and located in the burner end of the assembly. The combustion air flowing through the primary air tube preferably flows past atomizing nozzle 50. In the preferred embodiment of the burner assembly, atomizing nozzle 50 is located at outlet end 63 of primary air tube 60.

Still referring to FIG. 6, in the preferred embodiment of the burner assembly 10, liquid fuel supply tube 66 is mounted within primary air tube 62 so as to convey liquid fuel (such as fuel oil) to atomizing nozzle 50. Also in the preferred embodiment of burner assembly 10, compressed atomizing air supply tube 68 is mounted within primary air tube 62 so as to convey compressed air to atomizing nozzle 50. Also in the preferred embodiment of burner assembly 10, means 69 is provided for conveying the liquid fuel through the liquid fuel supply tube at a pressure of between about 50 psi and about 100 psi. The preferred means 69 may be any suitable source for providing liquid fuel under pressure such as a pump and valve arrangement or the like. Also in the preferred embodiment of burner assembly 10, means 71 is provided for conveying compressed air through the compressed atomizing air supply tube at a pressure of between about 50 psi and about 100 psi. The preferred means 71 may be any suitable source for providing air under pressure such as a pump and valve arrangement. The combustion air conveyed to the atomizing nozzle by the preferred primary air tube 62 helps to eliminate large oil droplets or overspray from escaping the flame when the burner assembly is firing on liquid fuel.

Referring still to FIG. 6, the preferred burner assembly 10 is adapted to produce a stabilizing gas base flame (not shown) in the area of atomizing nozzle 50. More particularly, when the preferred burner assembly 10 is firing on gaseous fuel only, raw natural gas may be fed to the atomizing nozzle via the liquid fuel supply tube 66. Means 72 is provided to supply natural gas to the liquid fuel supply tube. Preferably, the amount of raw natural gas fed through the liquid fuel supply tube to produce the stabilizing gas base flame is approximately 1-2% of the total capacity of the burner assembly. The stabilizing gas base flame thus produced is not a pre-mix flame. Further, the preferred stabilizing gas base flame is adapted to be automatically shut off when the main flame is stable. The stabilizing gas base flame is adapted to enhance the stability of the main flame, particularly in the lower half of the range of the main flame.

Still referring to FIG. 6, the preferred burner assembly 10 includes air deflector 73. The preferred air deflector is mounted in housing 12 and is adapted to direct air flow from the impeller to the burner end. More particularly, the preferred air deflector 73 is mounted to the top of housing 12 and is adapted to uniformly direct air flow from the impeller to the top and the bottom of the housing. It is also contemplated that the burner assembly may not include an air deflector.

Figure 7:
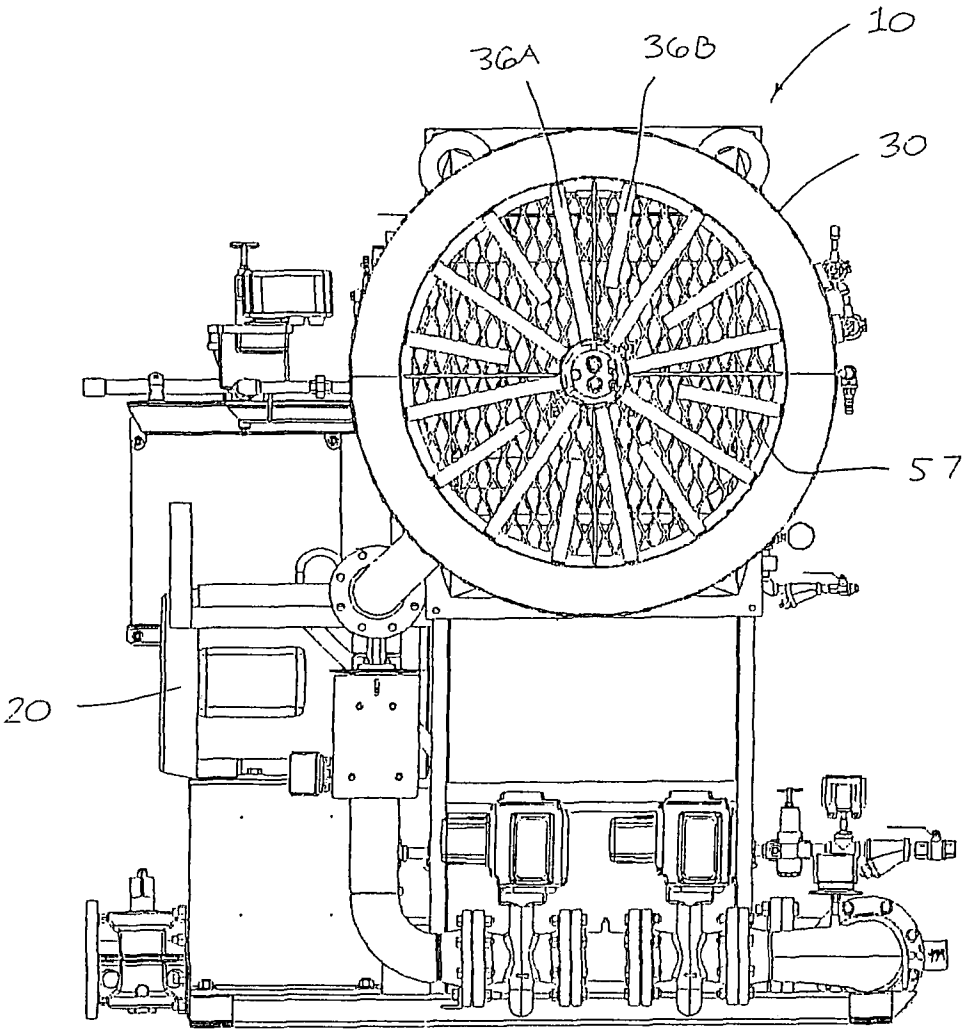
FIG. 7 is a partial sectional right side view of the preferred embodiment of the burner assembly illustrated in FIGS. 1-6 taken along sectional line B-B of FIG. 2.
Figure 7A:
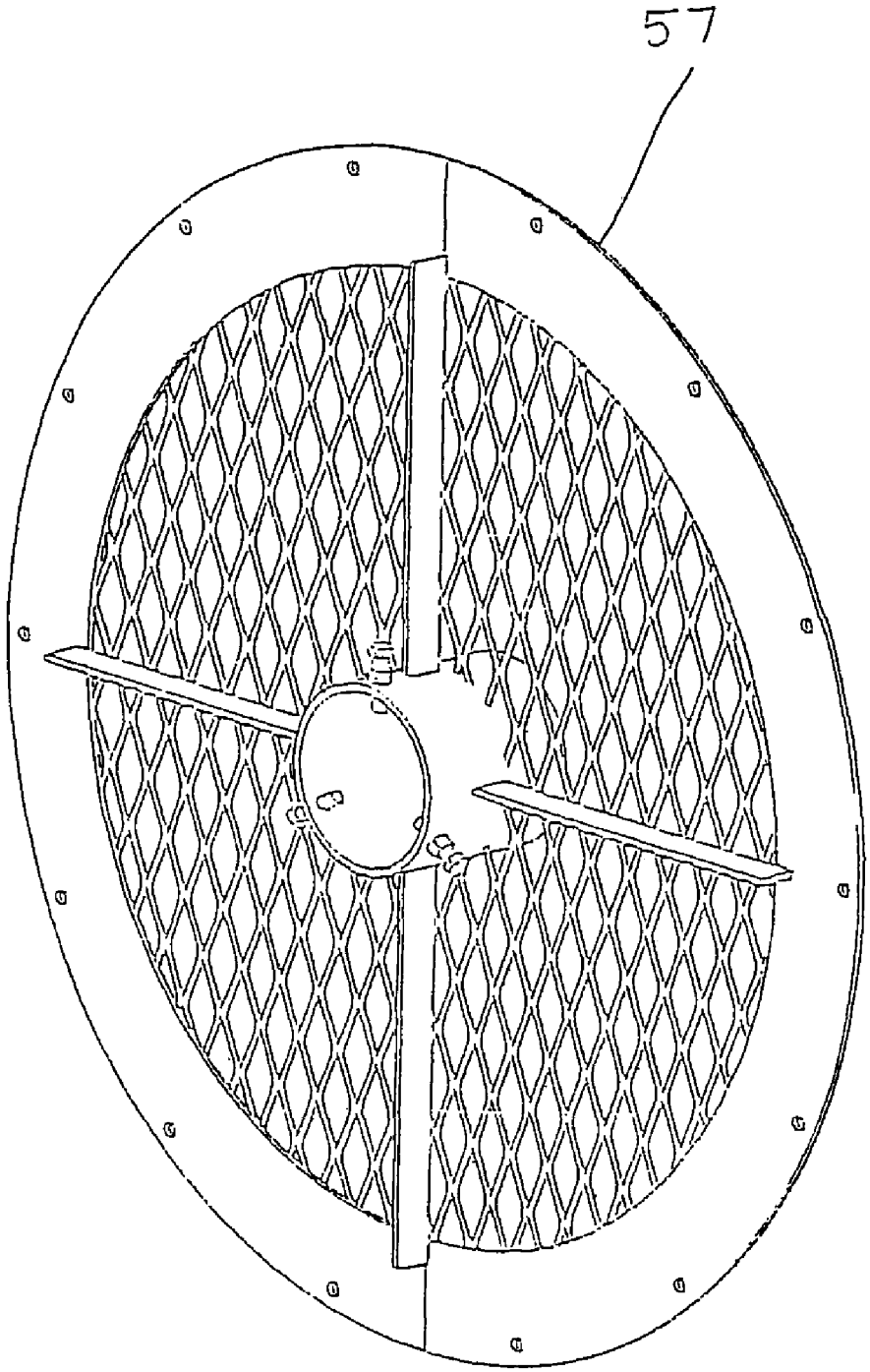
FIG. 7A is a perspective view of a preferred embodiment of a screen in accordance with the present invention.
Figure 8:
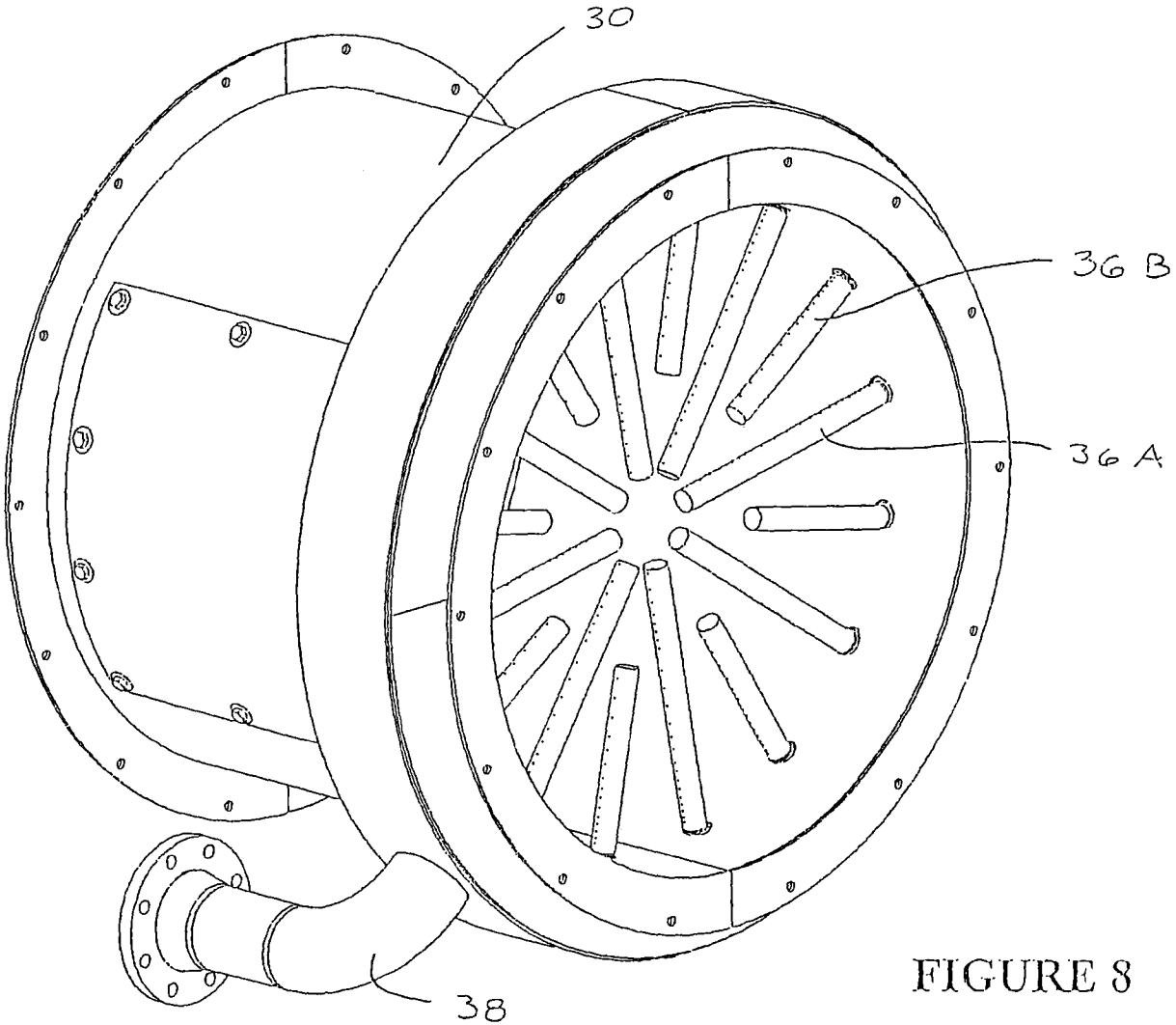
FIG. 8 is a perspective view of the preferred gas injection section of the burner assembly illustrated in FIGS. 1-7.

Referring now to FIGS. 7, 7A and 8, the preferred gas injection section 30 and straightening screen 57 of the preferred burner assembly 10 shown in FIGS. 1-6 are illustrated. More particularly, FIG. 7 illustrates a right side view of the preferred burner assembly 10 taken along sectional line B-B of FIG. 2. FIGS. 7 and 8 illustrate the plurality of preferred pre-mix gas injection nozzles 36A and 36B radially mounted in the preferred gas injection section 30. While FIGS. 7 and 8 illustrate a plurality of pre-mix gas injection nozzles mounted radially in the gas injection section, it is contemplated within the scope of the invention that one or more pre-mix gas injection nozzles may be arranged in any configuration suitable for mixing fuel and air. The preferred pre-mix gas injection nozzles 36A and 36B are mounted about the periphery of the housing of the burner assembly. Also shown in FIGS. 7 and 8, the preferred pre-mix gas injection nozzle 36A is longer than the preferred pre-mix gas injection nozzle 36B in order to produce a more uniform and complete mixture of fuel and air in the preferred burner assembly. It is contemplated within the scope of the invention, however, that the pre-mix gas injection nozzles may be any suitable length for uniformly and completely mixing the fuel and air in the burner assembly, provided that the pre-mix gas injection nozzles do not extend into the center of the burner assembly.

As shown in FIG. 7A, the preferred straightening screen 57 includes a plurality of openings through which combustion air flowing from the impeller to the burner end may flow. While the preferred straightening screen 57 is illustrated in FIG. 7A, it is contemplated within the scope of the invention that any suitable device having one or more openings adapted to permit combustion air to flow through may be used. For example, it is contemplated within the scope of the invention that a screen having larger or smaller openings that the screen illustrated in FIG. 7A may be used. It is further contemplated that the preferred straightening screen 57 may also be used as the preferred mixing screen 58. Like the preferred straightening screen, however, the preferred mixing screen may be any suitable device having one or more openings through which combustion air is adapted to flow.

Figure 9:
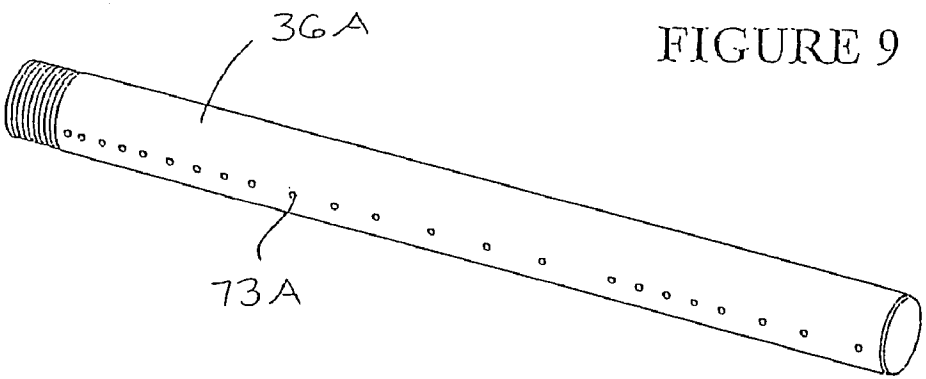
FIG. 9 is a perspective view of a preferred embodiment of the pre-mix gas injection nozzles of the burner assembly illustrated in FIGS. 1-8.
Figure 10:
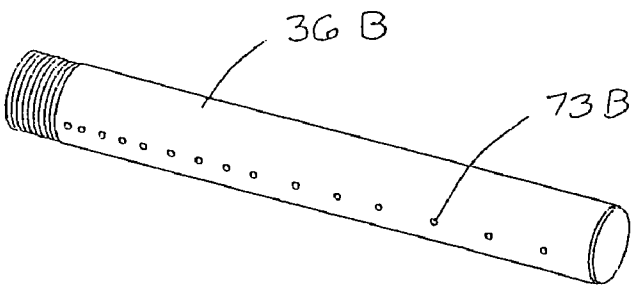
FIG. 10 is a perspective view of the preferred embodiment of the pre-mix gas injection nozzles of the burner assembly illustrated in FIGS. 1-9.

Referring now to FIGS. 9 and 10, a pair of preferred pre-mix gas injection nozzles in accordance with the present invention are illustrated. More particularly, each of the preferred pre-mix gas injection nozzles 36A and 36B are generally cylindrical in shape and include at least one orifice, such as orifices 73A and 73B. It is understood that the pre-mix gas injection nozzles may be any suitable configuration, and the at least one orifice therein may be spaced at any location suitable for a uniform and complete mixing of fuel and air in the housing. The preferred orifice has a diameter of no more than about 0.125 inches.

Figure 11:
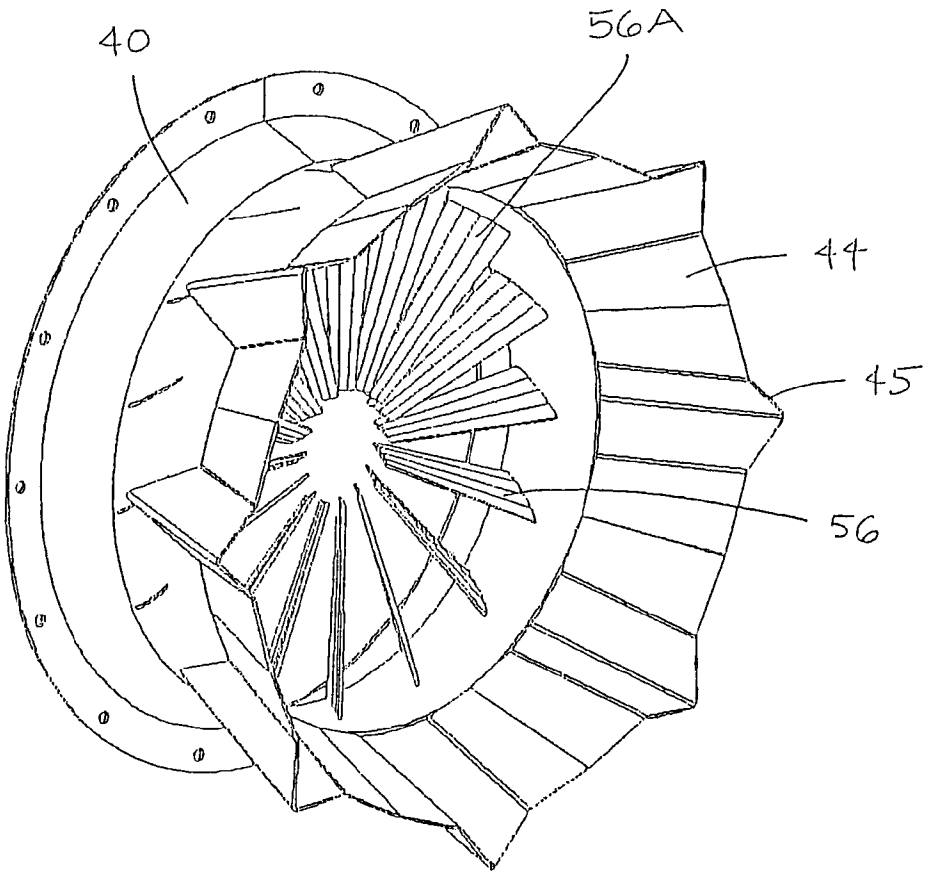
FIG. 11 is a perspective view of a portion of the preferred burner end of the burner assembly illustrated in FIGS. 1-10.
Figure 12:
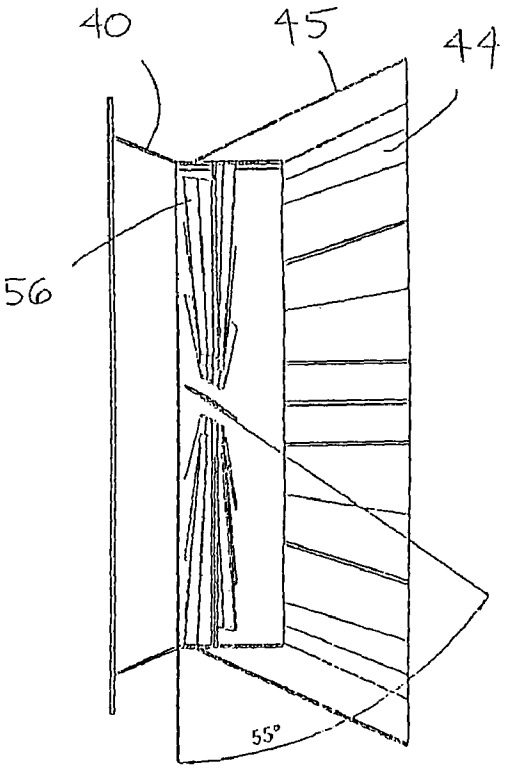
FIG. 12 is a partial sectional front view of a portion of the preferred burner end of the burner assembly illustrated in FIGS. 1-11.
Figure 13:
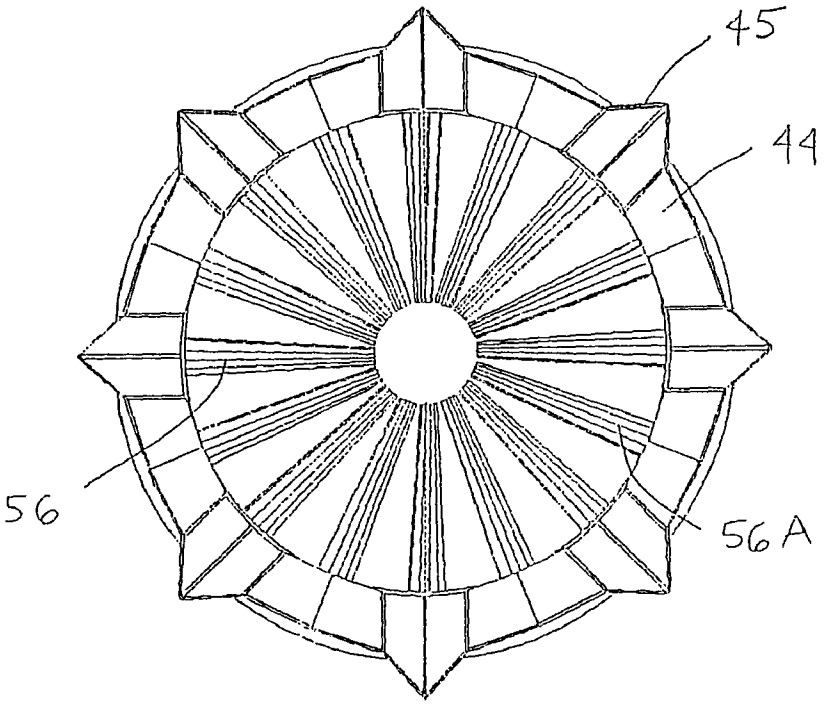
FIG. 13 is a right side view of a portion of the preferred burner end of the burner assembly illustrated in FIGS. 1-12.

Referring now to FIGS. 11-13, a portion of the preferred burner end of the burner assembly shown in FIGS. 1-10 is illustrated. More particularly, FIG. 11 is a perspective view, FIG. 12 is a partial sectional front view, and FIG. 13 is a right side view of a portion of the preferred burner end 16 of the preferred burner assembly 10 illustrated in FIGS. 1-10. As shown in FIGS. 11-13, the preferred burner end 16 of the preferred burner assembly 10 includes the preferred converging focusing cone 40, the preferred diverging conical discharge section 44 and the preferred spin vane 56. As shown in FIGS. 11-12, the preferred converging focusing cone 40 is located upstream of the preferred spin vane 56, and the preferred diverging conical discharge section 44 includes at least one expansion and contraction crease 45 adapted to permit the conical discharge section to expand and contract with temperature variations. As shown in FIG. 12, the preferred diverging conical discharge section 44 has an included angle of approximately 55°.

Figure 17:
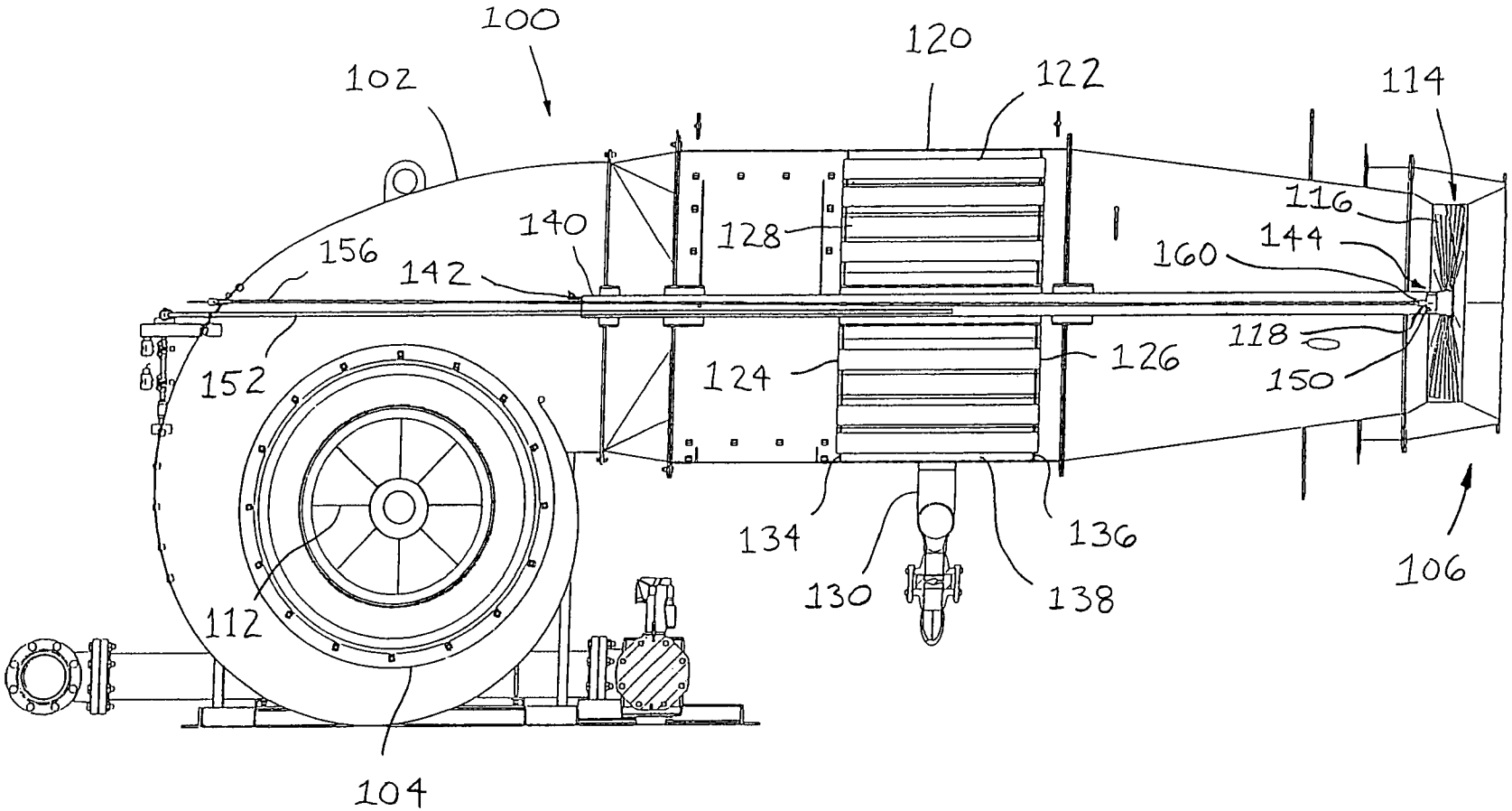
FIG. 17 is a partial sectional front view of a first alternative embodiment of the burner assembly in accordance with the invention described and claimed herein showing the preferred gas injection section.

Referring now to FIG. 17, a partial sectional front view of a first alternative embodiment of the burner assembly in accordance with the invention described and claimed herein is illustrated. More particularly, FIG. 17 illustrates preferred burner assembly 100 which includes housing 102 having air inlet 104 and burner end 106 having opening 108 (see FIG. 25). Preferred burner assembly 100 also includes motor 110 (see FIGS. 23 and 25) and impeller 112 mounted in the housing. The preferred impeller 112 is in fluid communication with air inlet 104, in mechanical communication with motor 110 and adapted to direct air from the air inlet towards burner end 106 of housing 102. The preferred burner assembly 100 further includes spin vane 114 having at least one spin vane blade 116 (see also FIG. 25). The preferred spin vane 114 is fixedly mounted in burner end 106 of housing 102 and adapted to direct the flow of air in the burner end. In addition, the preferred burner assembly 100 includes igniter 118 (see also FIG. 25) mounted in burner end 106 of housing 102. As shown in FIG. 17, the preferred igniter 118 is adapted to ignite the air and fuel mixture in the burner end of the housing to produce a main flame.

Still referring to FIG. 17, the preferred burner assembly 100 includes gas injection section 120 having a plurality of gas injection tubes 122 that are disposed substantially parallel to each other. The preferred the plurality of gas injection tubes 122 are mounted about the periphery of housing 102 such that the longitudinal axis 123 (see FIG. 21) of each tube is substantially parallel to the longitudinal axis of every other tube and such that the longitudinal axis of each tube is spaced at least approximately three inches apart from the longitudinal axis of every other tube. Each of the preferred plurality of gas injection tubes 122 have tube inlet end 124, tube outlet end 126 and at least one aperture 128. Each of the preferred plurality of gas injection tubes 122 is approximately 30 inches in length and approximately 3 inches in diameter and adapted to permit combustion air to flow from tube air inlet end 124 towards burner end 106 of the housing 102. Each of the preferred plurality of gas injection tubes 122 includes at least seven apertures 128 disposed around the circumference of each gas injection tube. The preferred apertures 128 are spaced approximately equally apart from each other near tube inlet end 124. In addition, the preferred apertures 128 may be sized in accordance with the rated heat release for the burner assembly in which they are contained. More particularly, preferred burner assembly 100 has a rated heat release which requires a rated heat release amount of gaseous fuel. The preferred apertures 128 are sized so as to convey an amount of gaseous fuel equal to approximately the rated heat release amount of gaseous fuel plus ten percent at a pressure of 4 psig in the area of gas manifold 130. A given pressure difference across the apertures produces a predictable gas flow and allows for a determination of the required number of apertures to achieve a rated flow. In one preferred embodiment, each of the apertures 128 has a diameter of approximately 0.14 inches and is located approximately 2.5 inches from tube inlet end 124.

Figure 18:
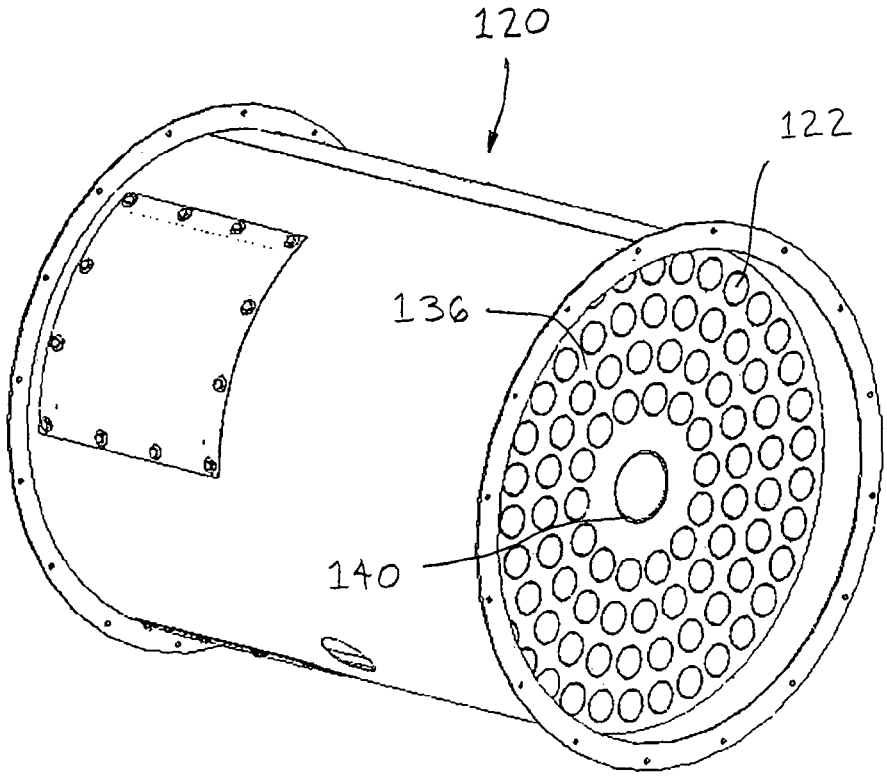
FIG. 18 is a perspective view of the preferred gas injection section of the first alternative embodiment of the burner assembly illustrated in FIG. 17.
Figure 19:
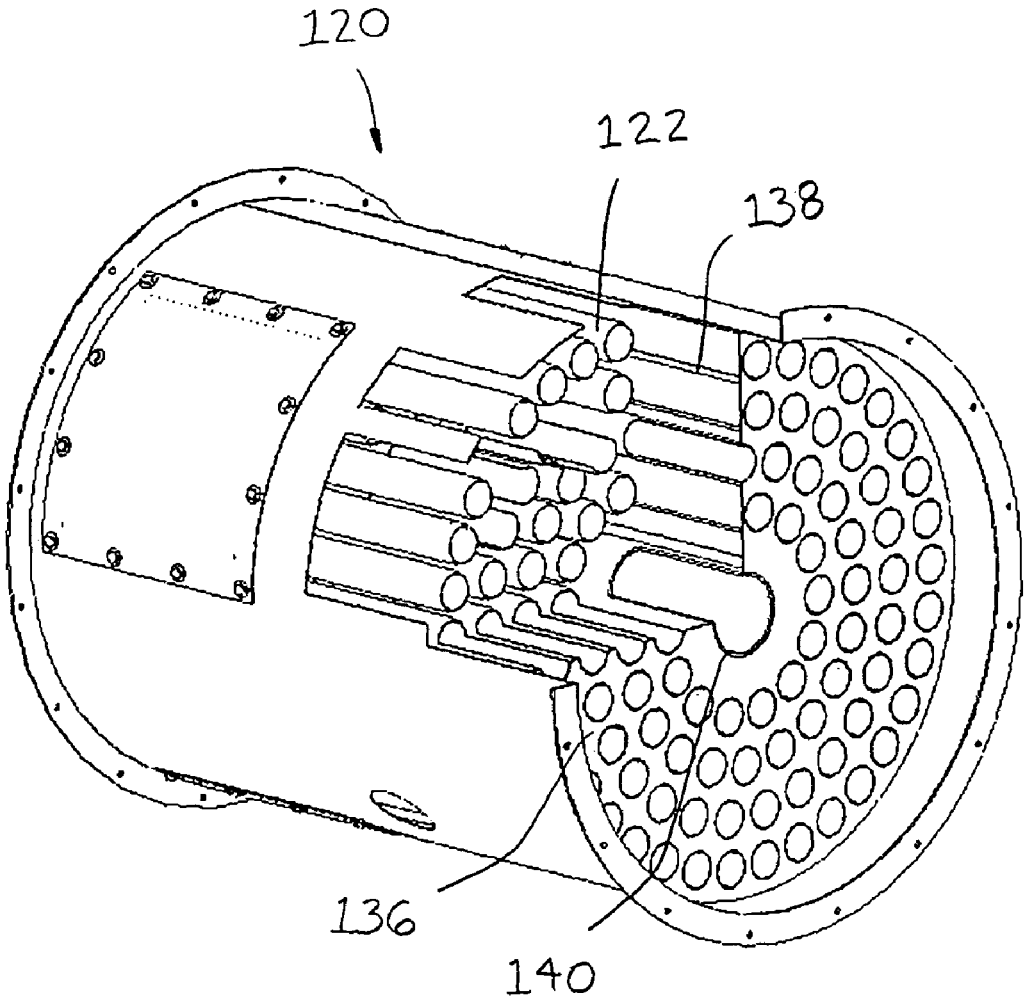
FIG. 19 is a partial sectional perspective view of the preferred gas injection section of the first alternative embodiment of the burner assembly illustrated in FIGS. 17-18.
Figure 20:
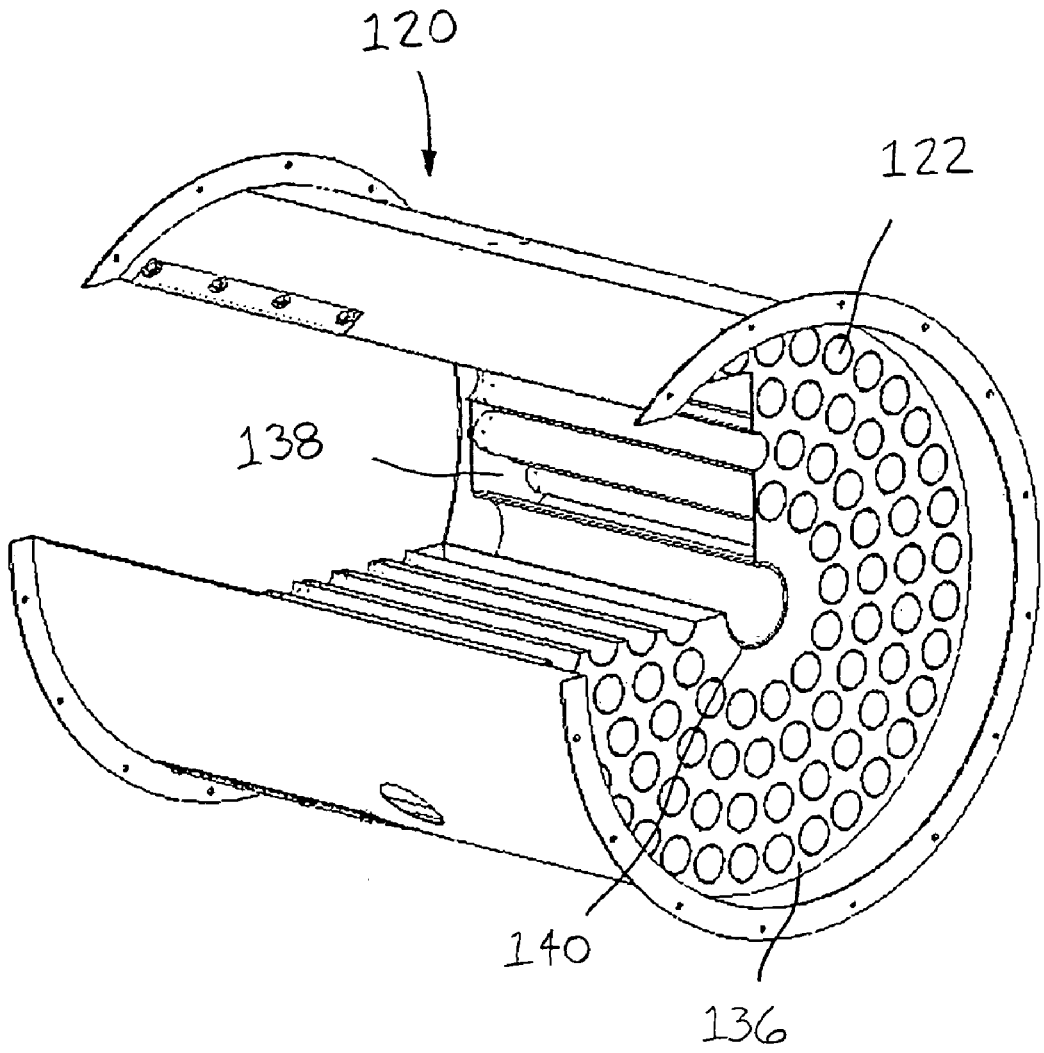
FIG. 20 is a partial sectional perspective view of the preferred gas injection section of the first alternative embodiment of the burner assembly illustrated in FIGS. 17-19.

While FIG. 17, like FIGS. 18-20, illustrates the preferred configuration and arrangement of the gas injection section, it is contemplated within the scope of the invention that the plurality of gas injection tubes may be configured and arranged in any suitable manner adapted to uniformly and completely mix combustion air and gaseous fuel. It is further contemplated that the number of gas injection tubes may be more or less than the number of gas injection tubes illustrated in FIGS. 17-20 and 25.

Still referring to FIG. 17, the preferred gas injection section 120 also includes first tube sheet 134 disposed near tube inlet ends 124 of the plurality of gas injection tubes and second tube sheet 136 disposed near tube outlet ends 126 of the plurality of gas injection tubes. Each preferred tube inlet end 124 of the plurality of gas injection tubes 122 extends approximately 0.5 inches beyond first tube sheet 134 and each preferred tube outlet end 126 of the plurality of gas injection tubes 122 extends approximately 0.5 inches beyond second tube sheet 136. In the preferred embodiment, first tube sheet 134, second tube sheet 136, housing 102, the primary air tube (described below) and the plurality of gas injection tubes 122 produce a substantially sealed gas injection chamber 138 (see also FIGS. 19-20). The preferred gas manifold 130 is adapted to convey gaseous fuel to substantially sealed gas injection chamber 138. Preferably, gaseous fuel conveyed to gas injection chamber 138 by gas manifold 130 enters the plurality of gas injection tubes 122 through apertures 128 and is mixed with combustion air in the plurality of gas injection tubes. While FIG. 17, like FIGS. 18-20, illustrates the preferred configuration and arrangement of the first and second tube sheets, it is contemplated within the scope of the invention that the tube sheets may be configured and arranged in any suitable manner so as to form a substantially sealed gas injection chamber.

Still referring to FIG. 17, the preferred burner assembly 100 is adapted to selectively fire on gaseous fuel, liquid fuel or both gaseous fuel and liquid fuel. As shown in FIG. 17, the preferred burner assembly 100 includes primary air tube 140 mounted within housing 102. The preferred primary air tube 140 has primary air tube inlet end 142 and primary air tube outlet end 144. The preferred primary air tube inlet end 142 is located downstream of impeller 112 and the preferred primary air tube outlet end 144 is located in burner end 106. The preferred burner assembly 100 also includes atomizing nozzle 150 located at primary air tube outlet end 144 and liquid fuel supply tube 152 mounted within primary air tube 140. While it is contemplated that the burner assembly may not include an atomizing nozzle for firing on liquid fuel, such a nozzle may be provided. It is also contemplated that a "dummy nozzle" may be provided in the burner assembly. The preferred liquid fuel supply tube 152 is adapted to convey liquid fuel to atomizing nozzle 150. The preferred liquid fuel supply tube 152 is also adapted to convey gaseous fuel to produce a stabilizing gas base flame in burner end 106. The preferred burner assembly 100 further includes bluff body 154 (see FIG. 25) mounted around the periphery of the primary air tube outlet end 144 and compressed atomizing air supply tube 156 mounted within primary air tube 140. The preferred compressed atomizing air supply tube 156 is adapted to convey compressed air to atomizing nozzle 150. The preferred burner assembly 100 still further includes pilot assembly 160 mounted at burner end 106, said pilot assembly being adapted to produce a pilot flame. While FIG. 17 illustrates the preferred liquid fuel assembly, it is contemplated within the scope of the invention that the liquid fuel assembly may be configured and arranged in any suitable manner so as to permit burner assembly 100 to fire on liquid fuel.

Referring now to FIGS. 18 through 20, perspective views of the preferred gas injection section of burner assembly 100 are illustrated. As shown in FIGS. 18 through 20, the preferred gas injection section 120 includes a plurality of gas injection tubes 122 that are disposed substantially parallel to each other and mounted about the periphery of housing 102 such that primary air tube 140 may pass therethrough. Further, the preferred gas injection tubes 122 are arranged such that they form concentric circles about the longitudinal axis of the primary air tube. The preferred gas injection section also includes second tube sheet 136 which seals one end of substantially sealed gas injection chamber 138 (see FIGS. 19 and 20).

Figure 21:
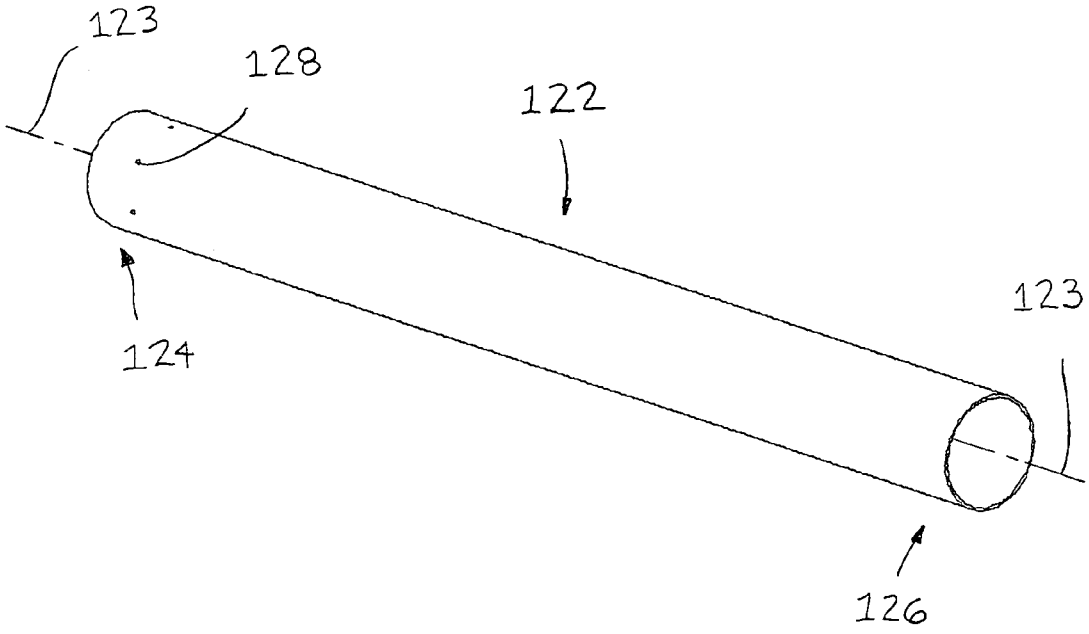
FIG. 21 is a perspective view of an exemplary gas injection tube of the first alternative embodiment of the burner assembly illustrated in FIGS. 17-20.

Referring now to FIG. 21, a perspective view of an exemplary gas injection tube of burner assembly 100 is illustrated. As shown in FIG. 21, exemplary gas injection tube 122 includes a plurality of apertures 128 that are equally spaced apart from each other and disposed around the circumference of the tube near the tube inlet end 124.

Figure 22:
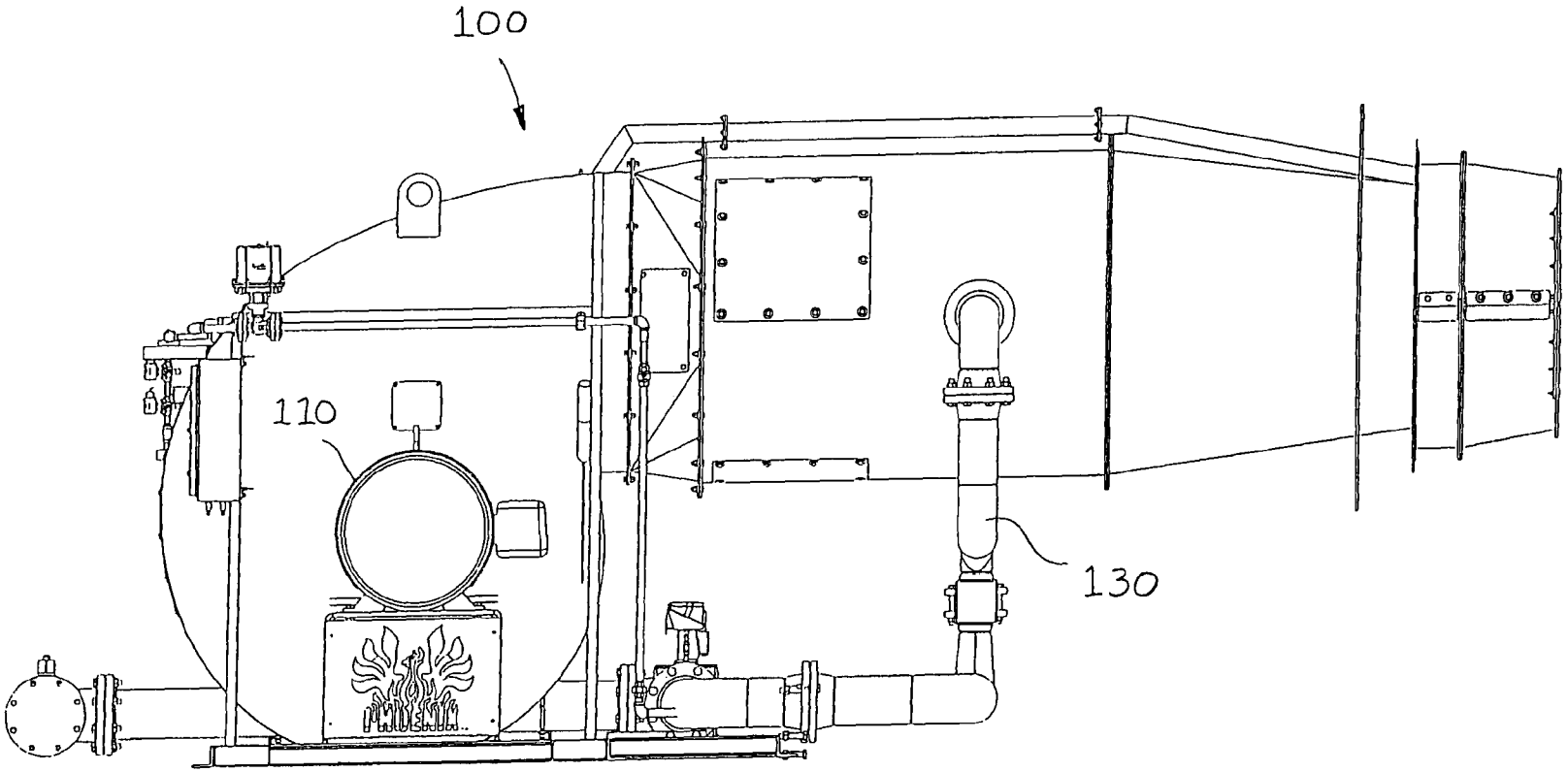
FIG. 22 is a front view of the first alternative embodiment of the burner assembly illustrated in FIGS. 17-21 showing the preferred gas manifold.
Figure 23:
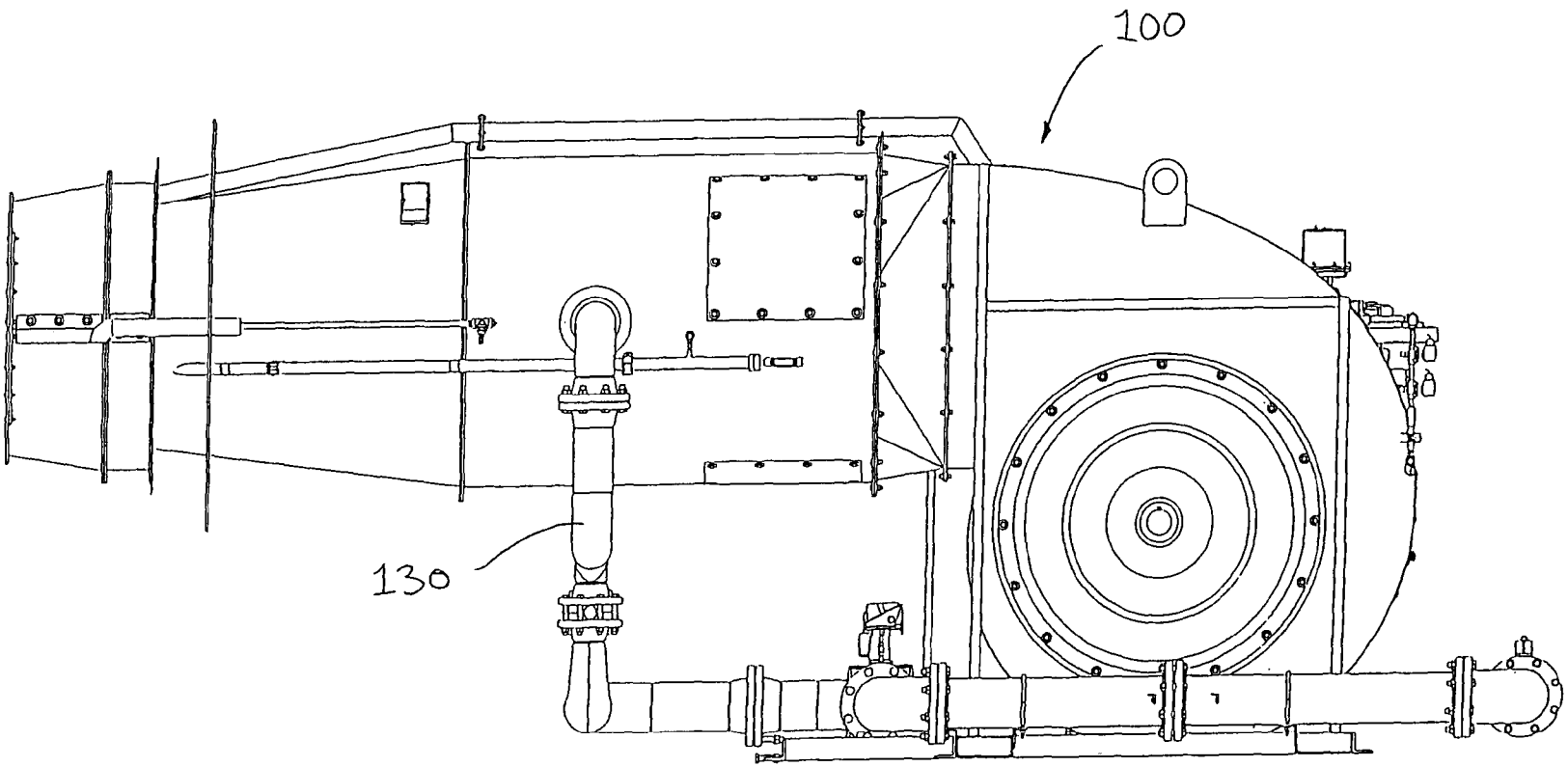
FIG. 23 is a back view of the first alternative embodiment of the burner assembly illustrated in FIGS. 17-22.
Figure 24:
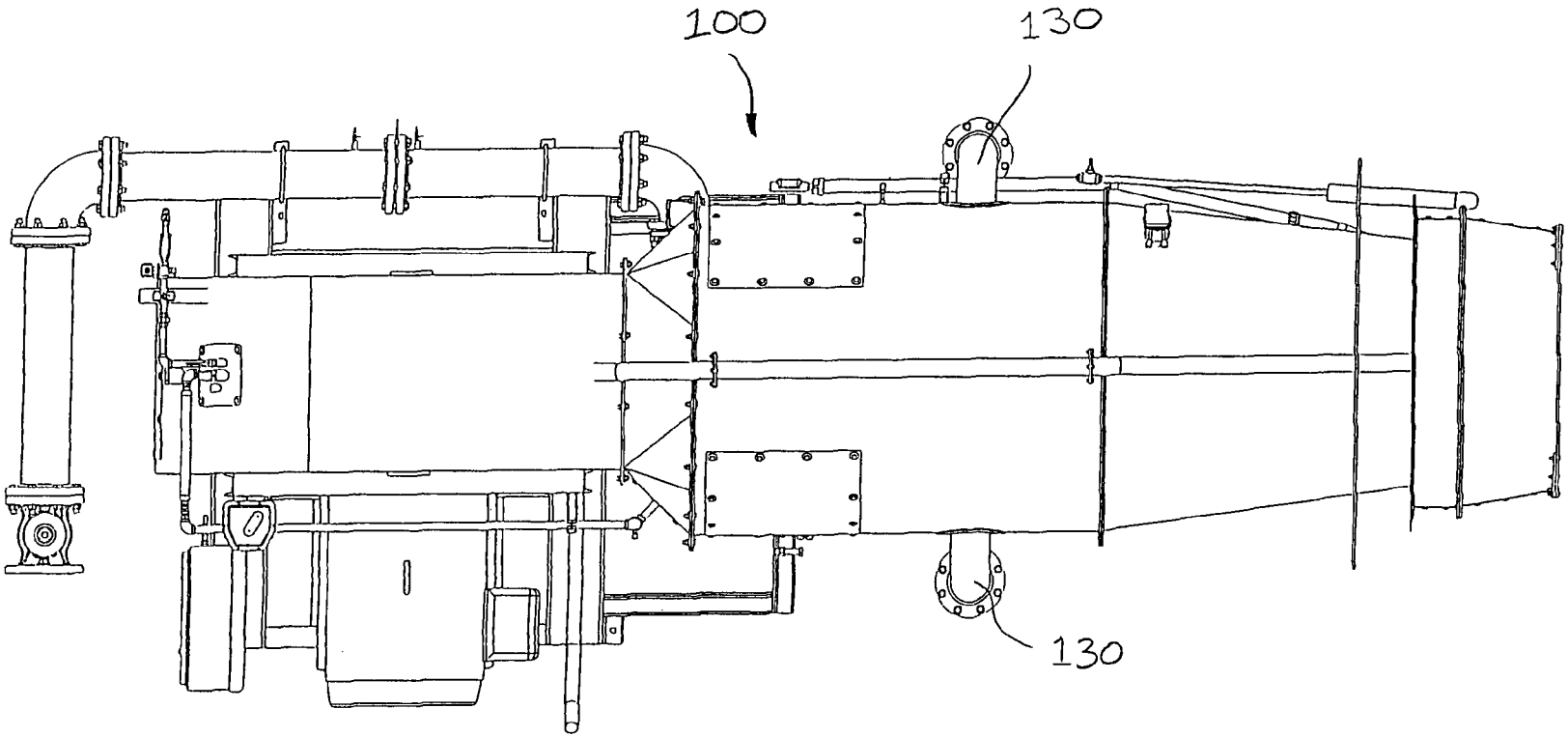
FIG. 24 is a top view of the first alternative embodiment of the burner assembly illustrated in FIGS. 17-23.
Figure 25:
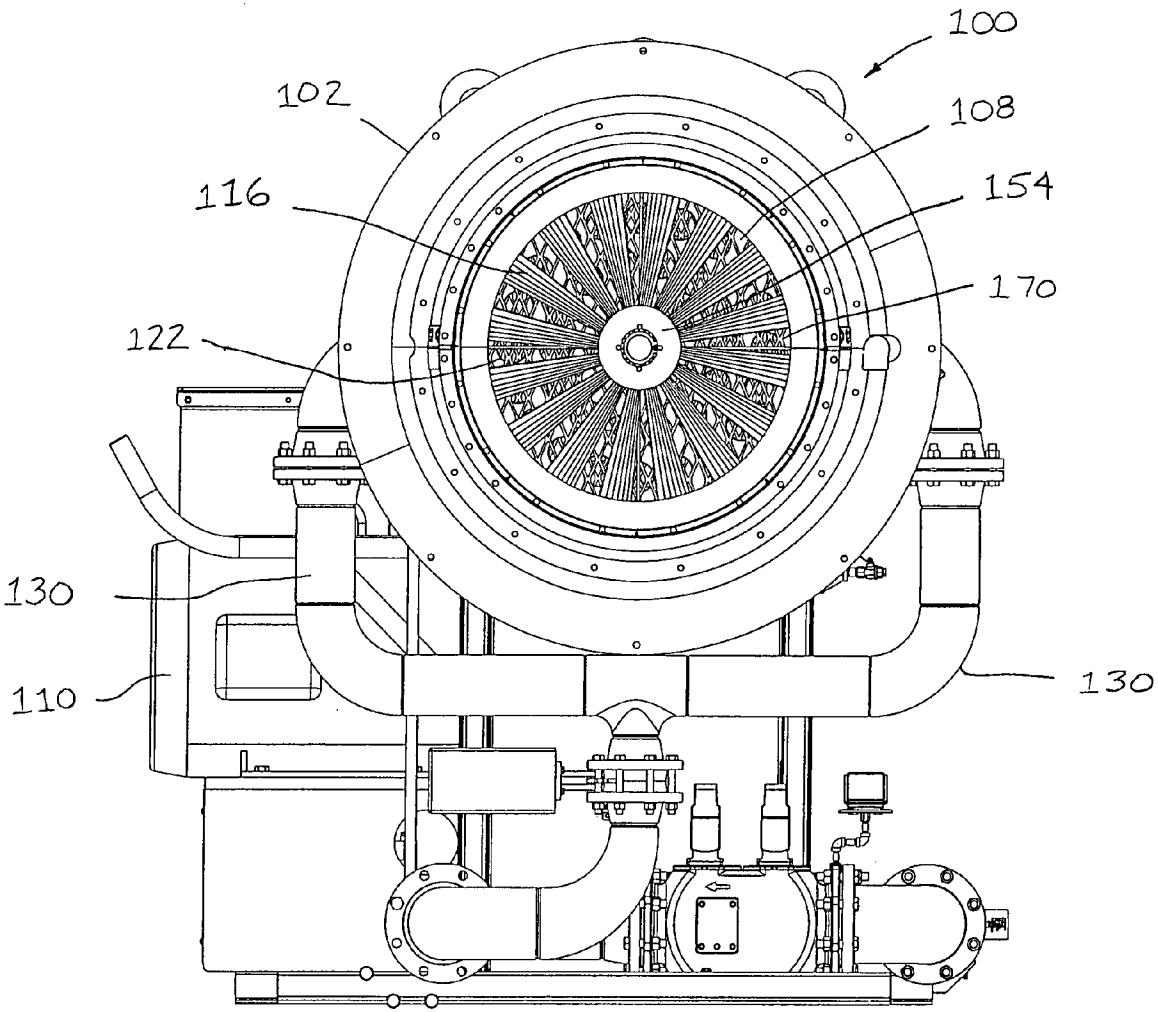
FIG. 25 is a right side view of the first alternative embodiment of the burner assembly illustrated in FIGS. 17-24.

Referring now to FIG. 22, a front view of burner assembly 100 showing preferred gas manifold 130 is illustrated. FIG. 23, FIG. 24 and FIG. 25 are back, top and right side views, respectively, also showing the preferred manifold 130 of burner assembly 100. As shown in FIGS. 22 through 25, the preferred gas manifold 130 is adapted to convey gaseous fuel to the gas injection section of burner assembly 100. More particularly, the preferred gas manifold 130 is adapted to convey gaseous fuel to substantially sealed gas injection chamber 138 (see FIGS. 17, 19 and 20). As also shown in FIG. 25, the preferred burner assembly 100 includes screen 170 mounted in the housing of the burner assembly downstream from impeller 112. While FIGS. 22-25 illustrate the preferred configuration and arrangement for the gas manifold, it is contemplated within the scope of the invention that the gas manifold may be configured and arranged in any suitable manner so as to convey gaseous fuel to the gas injection section of the burner assembly. It is further contemplated within the scope of the invention that the at least one screen mounted in the housing may be configured and arranged in any suitable manner so as to direct and mix combustion air and/or fuel in the burner assembly.

In operation, several advantages of the burner assembly of the invention are achieved. For example, the preferred burner assembly is capable of selectively firing on gaseous fuel, liquid fuel, or both gaseous and liquid fuel. The preferred burner assembly is capable of firing on gaseous and/or liquid fuels without physically altering the components of the apparatus, changing the firing rate of the apparatus, or shutting down the apparatus. The preferred burner assembly is also adapted to fire on oil or liquid propane without changing the atomizing nozzle and capable of supplying natural gas or propane to the pilot assembly for use as pilot fuel.

In addition, the preferred burner assembly produces a short, narrow and stable main flame configuration. The improved main flame configuration reduces the amount of combustion space required to heat and dry aggregate materials for the production of hot mix asphalt. The improved main flame configuration is adapted for use on a wide variety of different-sized combustion chambers having different-sized combustion spaces.

Further, the spacing and configuration of the spin vane, the bluff body, and the gas injection tubes in the preferred embodiment of the invention results in a more complete and uniform mixture of combustion air, gaseous fuel and/or liquid fuel. The spin vane may be fixed because adjustment of the flame configuration is not required, even when using the burner assembly with a variety of different-sized dryer drums. As a result, costly and complicated adjustable spin vanes may be eliminated. In addition, the converging focusing cone section reduces the temperature of the dryer drum breech plate.

Still further, the configuration and arrangement of the preferred burner assembly provides improved aerodynamics. More particularly, the configuration and arrangement of the gas injection section of the preferred burner assembly more rapidly, completely, and uniformly mixes fuel and air, thereby providing a more rapid combustion, improving combustion intensity, reducing the combustion space required in the asphalt drum, and reducing CO, NOx, $CO_2$ and VOC emissions in the combustion space. In addition, the preferred burner assembly results in reduced noise levels during operation.

Additionally, the preferred burner assembly is capable of firing on low excess air pre-mix gas and producing a stabilizing gas base flame. The preferred burner assembly is also less complicated and expensive to manufacture, operate and maintain than conventional burner assemblies.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, as would be understood and appreciated by a person having ordinary skill in the art to which the invention relates.

What is claimed is:

1. A burner assembly comprising:

(a) a housing including an air inlet and a burner end having an opening;

(b) a motor;

(c) an impeller mounted in the housing, said impeller being in fluid communication with the air inlet, in mechanical communication with the motor and adapted to direct air from the air inlet towards the burner end of the housing;

(d) a primary air tube, said primary air tube being disposed in the housing;

(e) a plurality of gas injection tubes that are disposed substantially parallel to each other and substantially parallel to the primary air tube, each of said plurality of gas injection tubes having a tube inlet end in the housing, a tube outlet end in the housing and at least one aperture;

(f) a first tube sheet disposed substantially perpendicular to the primary air tube near the tube inlet ends of the plurality of gas injection tubes, said first tube sheet being substantially planar and adapted to prevent air from flowing around the plurality of gas injection tubes;

(g) a second tube sheet disposed substantially perpendicular to the primary air tube near the tube outlet ends of the plurality of gas injection tubes, said second tube sheet being substantially planar and adapted to prevent air from flowing around the plurality of gas injection tubes;

(h) a spin vane comprising at least one spin vane blade, said spin vane being mounted in the burner end of the housing and adapted to direct the flow of air in the burner end; and, (i) an igniter mounted in the burner end of the housing, said igniter being adapted to ignite the air and fuel mixture in the burner end of the housing to produce a main flame;

wherein the tube inlet end is adapted to receive air directed from the air inlet.

2. The burner assembly of claim 1 wherein the plurality of gas injection tubes are mounted about the periphery of the housing.

3. The burner assembly of claim 1 wherein each of the plurality of gas injection tubes has a longitudinal axis, and wherein the longitudinal axis of each gas injection tube is substantially parallel to the longitudinal axis of each of the other gas injection tubes, and wherein the longitudinal axis of each gas injection tube is spaced at least approximately three inches apart from the longitudinal axis of each of the other gas injection tubes.

4. The burner assembly of claim 1 wherein each of the plurality of gas injection tubes is approximately 30 inches in length and approximately 3 inches in diameter.

5. The burner assembly of claim 1 wherein each of the plurality of gas injection tubes is adapted to permit combustion air to flow from the tube air inlet end towards the burner end of the housing.

6. The burner assembly of claim 1 wherein each of the plurality of gas injection tubes comprises at least seven apertures disposed around the circumference of each gas injection tube and spaced approximately equally apart from each other near the tube inlet end.

7. The burner assembly of claim 1 wherein said burner assembly has a rated heat release which requires a rated heat release amount of gaseous fuel, and wherein each of the at least one apertures is sized so as to convey an amount of gaseous fuel equal to approximately the rated heat release amount of gaseous fuel plus ten percent at a pressure of 4 psig in the area of the gas manifold.

8. The burner assembly of claim 1 wherein each of the apertures has a diameter of approximately 0.14 inches and is located approximately 2.5 inches from the tube inlet end.

9. The burner assembly of claim 1 wherein each tube inlet end of the plurality of gas injection tubes extends approximately 0.5 inches beyond the first tube sheet and each tube outlet end of the plurality of gas injection tubes extends approximately 0.5 inches beyond the second tube sheet.

10. The burner assembly of claim 1 wherein the first tube sheet, the second tube sheet, the housing, primary air tube and the plurality of gas injection tubes produce a substantially sealed gas injection chamber.

11. The burner assembly of claim 10 further comprising a gas manifold adapted to convey gaseous fuel to the substantially sealed gas injection chamber.

12. The burner assembly of claim 11 wherein gaseous fuel conveyed to the gas injection chamber by the gas manifold enters the plurality of gas injection tubes through the apertures in the gas injection tubes.

13. The burner assembly of claim 11 wherein gaseous fuel conveyed to the gas injection chamber by the gas manifold is mixed with combustion air in the plurality of gas injection tubes.

14. The burner assembly of claim 1 wherein the spin vane is fixedly mounted in the burner end.

15. The burner assembly of claim 1 further including:

(j) at least one screen mounted in the housing of the burner assembly downstream from the impeller.

16. The burner assembly of claim 1, further including:

(j) an atomizing nozzle located at the primary air tube outlet end;

(k) a liquid fuel supply tube mounted within the primary air tube, said liquid fuel supply tube being adapted to convey liquid fuel to the atomizing nozzle;

(l) a bluff body mounted around the periphery of the primary air tube outlet end;

(m) a compressed atomizing air supply tube mounted within the primary air tube, said compressed atomizing air supply tube being adapted to convey compressed air to the atomizing nozzle; and wherein the primary air tube has a primary air tube inlet end and a primary air tube outlet end, said primary air tube inlet end being located downstream of the impeller and said primary air tube outlet end being located in the burner end.

17. The burner assembly of claim 16 wherein the burner assembly is adapted to selectively fire on gaseous fuel, liquid fuel or both gaseous fuel and liquid fuel.

18. The burner assembly of claim 16 wherein the liquid fuel supply tube is adapted to convey gaseous fuel to produce a stabilizing gas base flame in the burner end.

19. The burner assembly of claim 16, further including:

(n) a pilot assembly mounted at the burner end, said pilot assembly being adapted to produce a pilot flame.

* * * * *